US008177922B2

(12) United States Patent
Odaka et al.

(10) Patent No.: US 8,177,922 B2
(45) **Date of Patent: *May 15, 2012**

(54) R-FE-B ANISOTROPIC SINTERED MAGNET

(75) Inventors: Tomoori Odaka, Osaka (JP); Hideyuki Morimoto, Osaka (JP); Kohshi Yoshimura, Osaka (JP); Shigeru Takaki, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 126 days.

This patent is subject to a terminal disclaimer.

(21) Appl. No.: 12/671,915

(22) PCT Filed: Sep. 2, 2008

(86) PCT No.: PCT/JP2008/002399

§ 371 (c)(1),
(2), (4) Date: Feb. 3, 2010

(87) PCT Pub. No.: WO2009/031292

PCT Pub. Date: Mar. 12, 2009

(65) Prior Publication Data

US 2011/0205006 A1 Aug. 25, 2011

(30) Foreign Application Priority Data

Sep. 4, 2007 (JP) ..... 2007-229113

(51) Int. Cl.
*H01F 1/057* (2006.01)

(52) U.S. Cl. ..... 148/302; 148/101; 148/122

(58) Field of Classification Search ..... None
See application file for complete search history.

(56) References Cited

U.S. PATENT DOCUMENTS

| | | | | |
|---|---|---|---|---|
| 5,383,978 | A | 1/1995 | Yamamoto et al. | |
| 2005/0098238 | A1 | 5/2005 | Morimoto et al. | |
| 2006/0278517 | A1 | 12/2006 | Machida et al. | |
| 2008/0223489 | A1 * | 9/2008 | Nagata et al. ..... | 148/101 |

(Continued)

FOREIGN PATENT DOCUMENTS

EP 1 643 513 A1 * 4/2006

(Continued)

OTHER PUBLICATIONS

Official Communication issued in corresponding European Patent Application No. 08829605.8, mailed on Aug. 3, 2011.

(Continued)

*Primary Examiner* — John Sheehan
(74) *Attorney, Agent, or Firm* — Keating & Bennett, LLP

(57) ABSTRACT

An R—Fe—B based anisotropic sintered magnet according to the present invention has, as a main phase, an $R_2Fe_{14}B$ type compound that includes a light rare-earth element RL (which is at least one of Nd and Pr) as a major rare-earth element R, and also has a heavy rare-earth element RH (which is at least one element selected from the group consisting of Dy and Tb). In the crystal lattice of the main phase, the c-axis is oriented in a predetermined direction. The magnet includes a portion in which at least two peaks of diffraction are observed within a 2θ range of 60.5 degrees to 61.5 degrees when an X-ray diffraction measurement is carried out using a CuK α ray on a plane that is located at a depth of 500 μm or less under a pole face of the magnet and that is parallel to the pole face.

4 Claims, 4 Drawing Sheets

U.S. PATENT DOCUMENTS

| | | | | |
|---|---|---|---|---|
| 2008/0286595 | A1 | 11/2008 | Yoshimura et al. | |
| 2009/0020193 | A1 | 1/2009 | Ohta et al. | |
| 2010/0182113 | A1 * | 7/2010 | Yoshimura et al. | 335/302 |
| 2010/0231338 | A1 | 9/2010 | Morimoto et al. | |
| 2011/0012699 | A1 * | 1/2011 | Odaka et al. | 335/302 |
| 2011/0205006 | A1 * | 8/2011 | Odaka et al. | 335/302 |

FOREIGN PATENT DOCUMENTS

| | | | | |
|---|---|---|---|---|
| EP | 1 993 112 | A1 | * | 11/2008 |
| JP | 62-074048 | A | | 4/1987 |
| JP | 2002-299110 | A | | 10/2002 |
| JP | 2004-296973 | A | | 10/2004 |
| JP | 2005-175138 | A | | 6/2005 |
| JP | 2005-285859 | A1 | | 10/2005 |
| WO | 2006/112403 | A1 | | 10/2006 |
| WO | 2007/088718 | A1 | | 8/2007 |
| WO | 2004/102391 | | * | 9/2007 |

OTHER PUBLICATIONS

Official Communication issued in International Patent Application No. PCT/JP2008/002399, mailed on Oct. 7, 2008.

English translation of Official Communication issued in corresponding International Application PCT/JP2008/002399, mailed on Apr. 8, 2010.

Official Communication issued in corresponding Chinese Patent Application No. 200880011063, mailed on Jul. 6, 2011.

* cited by examiner

R-FE-B ANISOTROPIC SINTERED MAGNET

TECHNICAL FIELD

The present invention relates to an R—Fe—B based anisotropic sintered magnet including an $R_2Fe_{14}B$ type compound (where R is a rare-earth element) as a main phase. More particularly, the present invention relates to an R—Fe—B based anisotropic sintered magnet, which includes a light rare-earth element RL (which is at least one of Nd and Pr) as a major rare-earth element R and in which a portion of the light rare-earth element RL is replaced with a heavy rare-earth element RH (which is at least one element selected from the group consisting of Dy and Tb).

BACKGROUND ART

An R—Fe—B based anisotropic sintered magnet, including an $Nd_2Fe_{14}B$ type compound phase as a main phase, is known as a permanent magnet with the highest performance, and has been used in various types of motors such as a voice coil motor (VCM) for a hard disk drive and a motor for a hybrid car and in numerous types of consumer electronic appliances. When used in motors and various other devices, the R—Fe—B based anisotropic sintered magnet should exhibit thermal resistance and coercivity that are high enough to withstand an operating environment at an elevated temperature.

As a means for increasing the coercivity of an R—Fe—B based anisotropic sintered magnet, a molten alloy, including a heavy rare-earth element RH as an additional element, may be used. According to this method, the light rare-earth element RL, which is included as a major rare-earth element R in an $R_2Fe_{14}B$ phase, is replaced with a heavy rare-earth element RH, and therefore, the magnetocrystalline anisotropy (which is a decisive quality parameter that determines the coercivity) of the $R_2Fe_{14}B$ phase improves. However, although the magnetic moment of the light rare-earth element RL in the $R_2Fe_{14}B$ phase has the same direction as that of Fe, the magnetic moments of the heavy rare-earth element RH and Fe have mutually opposite directions. That is why the remanence $B_r$ would decrease in proportion to the percentage of the light rare-earth element RL replaced with the heavy rare-earth element RH.

The metal structure of an R—Fe—B based anisotropic sintered magnet consists essentially of an $R_2Fe_{14}B$ phase, which is a main phase, and a so-called "R-rich phase" that has a relatively high R concentration and a low melting point, but also includes an R oxide phase and a B-rich phase ($R_{1.1}Fe_4B_4$ phase). Those additional phases, other than the main phases, are collectively called "grain boundary phases". In this case, it is the main phase that contributes to increasing the coercivity by substituting the heavy rare-earth element RH. On the other hand, the heavy rare-earth element RH, included in those grain boundary phases, will not directly contribute to increasing the coercivity of the magnet.

Meanwhile, as the heavy rare-earth element RH is one of rare natural resources, its use is preferably cut down as much as possible. For these reasons, the method in which a portion of the light rare-earth element RL is replaced with the heavy rare-earth element RH in the entire magnet (i.e., over not only the whole main phase but also the grain boundary phases) is not preferred.

To get the coercivity increased effectively with the addition of a relatively small amount of the heavy rare-earth element RH, it was proposed that an alloy or compound powder, including a lot of the heavy rare-earth element RH, be added to a powder of main phase material alloy including a lot of the light rare-earth element RL and then the mixture be compacted and sintered. According to this method, the heavy rare-earth element RH is distributed a lot in the outer periphery of the main phase grain, and therefore, the magnetocrystalline anisotropy of the $R_2Fe_{14}B$ phase can be improved efficiently. The R—Fe—B based anisotropic sintered magnet has a nucleation-type coercivity generating mechanism. That is why if a lot of the heavy rare-earth element RH is distributed only in the outer periphery of the main phase (i.e., near the grain boundary thereof), the magnetocrystalline anisotropy of all crystal grains is improved, the nucleation of reverse magnetic domains can be interfered with, and the coercivity increases as a result. At the core of the main phase crystal grains, no light rare-earth element RL is replaced with the heavy rare-earth element RH. Consequently, the decrease in remanence $B_r$ can be minimized there, too. Such a technique is disclosed in Patent Document No. 1, for example.

If this method is actually adopted, however, the heavy rare-earth element RH has an increased diffusion rate during the sintering process (which is carried out at a temperature of 1,000° C. to 1,200° C. on an industrial scale) and could diffuse to reach the core of the main phase crystal grains, too. For that reason, it is not easy to obtain the expected crystal structure in which the heavy rare-earth element RH is included in increased concentrations in only the outer periphery of the main phase.

As another method for increasing the coercivity of an R—Fe—B based anisotropic sintered magnet, a metal, an alloy or a compound including a heavy rare-earth element RH is deposited on the surface of the sintered magnet and then thermally treated and diffused. Then, the coercivity could be recovered or increased without decreasing the remanence so much.

Patent Document No. 2 teaches forming a thin-film layer, including R' that is at least one element selected from the group consisting of Nd, Pr, Dy, and Tb on the surface of a sintered magnet body to be machined and then subjecting it to a heat treatment within either a vacuum or an inert atmosphere, thereby turning a deformed layer on the machined surface into a repaired layer through a diffusion reaction between the thin-film layer and the deformed layer and recovering the coercivity.

Patent Document No. 3 discloses that a metallic element R (which is at least one rare-earth element selected from the group consisting of Y, Nd, Dy, Pr, and Tb) is diffused to a depth that is at least equal to the radius of crystal grains exposed on the uppermost surface of a small-sized magnet while the thin film is being deposited, thereby repairing the damage done on the machined surface and increasing $(BH)_{max}$.

Patent Document No. 4 discloses that by depositing a CVD film, consisting mostly of a rare-earth element, on the surface of a magnet with a thickness of 2 mm or less and then subjecting it to a heat treatment, the rare-earth element would diffuse inside the magnet, the machined and damaged layer in the vicinity of the surface could be repaired, and eventually the magnet performance could be recovered.

Patent Document No. 5 discloses a method of sorbing a rare-earth element to recover the coercivity of a very small R—Fe—B based sintered magnet or its powder. According to the method of Patent Document No. 5, a sorption metal, which is a rare-earth metal such as Yb, Eu or Sm with a relatively low boiling point and with a relatively high vapor pressure, and a very small R—Fe—B based sintered magnet or its powder are mixed together, and then the mixture is subjected to a heat treatment to heat it uniformly in a vacuum while stirring it up. As a result of this heat treatment, the rare-earth metal is not only deposited on the surface of the sintered magnet but also diffused inward. Patent Document No. 5 also discloses an embodiment in which a rare-earth metal with a high boiling point such as Dy is sorbed (see Paragraph #0014 of Patent Document No. 5). In such an embodiment that uses Dy, for example, Dy is selectively heated to a high temperature by induction heating (with no temperature conditions specified). However, Dy has a boiling point of 2,560° C. According to Patent Document No. 5, Yb with a boiling point of 1,193° C. should be heated to a temperature of 800° C. to 850° C. but could not be heated sufficiently by normal resistance heating process. Considering this disclosure of Patent Document No. 5, it is presumed that the Dy be heated to a very high temperature. For example, to achieve a Dy vapor pressure that is almost as high as the vapor pressure at the Yb heating condition (of 800° C. to 850° C.) that is defined as a preferred temperature to advance the sorption favorably, Dy should be heated to approximately 1,800° C. to approximately 2,100° C. It is also disclosed that as for Yb, its sorption is realized at approximately 550° C. and Yb has a vapor pressure of about 10 Pa in that case. This value corresponds to the saturation vapor pressure of Dy at 1,200° C. That is to say, if Dy should be sorbed by the technique disclosed in Patent Document No. 5, then Dy should be heated to at least 1,200° C., and preferably to 1,800° C. or more. It should be noted that the saturation vapor pressures of respective elements are known physical property values. Patent Document No. 5 also states that according to any heating condition, the temperature of the very small R—Fe—B based sintered magnet and its powder is preferably kept within the range of 700° C. to 850° C.

And Patent Document No. 6 discloses a technique for improving the magnetization property, while reducing the amount of Dy used, by mixing together a material alloy powder with a relatively high Dy concentration and a material alloy powder with a relatively low Dy concentration and subjecting the mixture to a sintering process.

Patent Document No. 1: Japanese Patent Application Laid-Open Publication No. 2002-299110

Patent Document No. 2: Japanese Patent Application Laid-Open Publication No. 62-74048

Patent Document No. 3: Japanese Patent Application Laid-Open Publication No. 2004-304038

Patent Document No. 4: Japanese Patent Application Laid-Open Publication No. 2005-285859

Patent Document No. 5: Japanese Patent Application Laid-Open Publication No. 2004-296973

Patent Document No. 6: Japanese Patent Application Laid-Open Publication No. 2002-356701

DISCLOSURE OF INVENTION

Problems to be Solved by the Invention

According to any of the conventional techniques disclosed in Patent Documents Nos. 2, 3 and 4, a sintered magnet body has its surface coated with a film of rare-earth metal and then subjected to a heat treatment, thereby diffusing the rare-earth metal inside the sintered magnet body. That is why in the surface region of the sintered magnet body (to a depth of several ten μm under the surface), a big difference in rare-earth metal concentration at the interface between the rare-earth metal film deposited and the sintered magnet body should inevitably generate a driving force to diffuse the rare-earth metal into the core of the main phase as well. Consequently, the remanence $B_r$ drops. On top of that, the excessive rare-earth metal film components would be left a lot even in the grain boundary phases that would not contribute to increasing the coercivity.

Also, according to the conventional technique disclosed in Patent Document No. 5, the rare-earth metal is heated to, and deposited at, a temperature that is high enough to vaporize it easily. That is why a rare-earth metal film is also deposited on the surface of the sintered magnet body as in Patent Document Nos. 2 to 4. As the sintered magnet body itself is heated, the rare-earth metal also diffuses inside the sintered magnet body in the meantime. In the surface region of the sintered magnet body, however, the rare-earth metal film components would also inevitably diffuse and reach the core of the main phase and the remanence $B_r$ would drop, too. Furthermore, the film components would also be left a lot in the grain boundary phases as in Patent Document Nos. 2 to 4.

Furthermore, in order to sorb a rare-earth metal with a high boiling point such as Dy, the sorption material and the sintered magnet body are both heated by induction heating process. That is why it is not easy to heat only the rare-earth metal to a sufficiently high temperature and yet maintain the sintered magnet body at a temperature that is low enough to avoid affecting the magnetic properties. As a result, the sintered magnet body will often have a powder state or a very small size and is not easily subjected to the induction heating process in either case.

On top of that, according to the methods of Patent Documents Nos. 2 through 5, the rare-earth metal is also deposited a lot on unexpected portions of the deposition system (e.g., on the inner walls of the vacuum chamber and the process vessel) other than the sintered magnet body during the deposition process, which is against the policy of saving a heavy rare-earth element that is one of rare and valuable natural resources.

According to Patent Document No. 6, while the sintering process is being carried out, Dy will diffuse from a material alloy powder with a relatively high Dy concentration to a material alloy powder with a relatively low Dy concentration. However, the crystal grains will grow when the powder particles are combined with each other, for example. As a result, Dy will be distributed broadly within the main phase and the coercivity can not be increased so effectively or efficiently even when Dy is added.

It is therefore an object of the present invention to provide an R—Fe—B based anisotropic sintered magnet, of which the coercivity has been increased effectively with the addition of only a small amount of Dy.

Means for Solving the Problems

An R—Fe—B based anisotropic sintered magnet according to the present invention has, as a main phase, an $R_2Fe_{14}B$ type compound that includes a light rare-earth element RL (which is at least one of Nd and Pr) as a major rare-earth element R, and also has a heavy rare-earth element RH (which is at least one element selected from the group consisting of Dy and Tb). The magnet includes a portion in which at least two peaks of diffraction are observed within a 2θ range of 60.5 degrees to 61.5 degrees when an X-ray diffraction measurement is carried out using a CuK α ray on a plane that is located at a depth of 500 μm or less under a pole face of the magnet and that is parallel to the pole face.

In one preferred embodiment, the portion in which the at least two peaks of diffraction are observed within the 2θ range of 60.5 degrees to 61.5 degrees when subjected to the X-ray diffraction measurement forms part of the plane that is parallel to the pole face.

In another preferred embodiment, the portion in which the at least two peaks of diffraction are observed within the 2θ range of 60.5 degrees to 61.5 degrees when subjected to the X-ray diffraction measurement has an area of 1 $mm^2$ or more on the plane that is parallel to the pole face.

In still another preferred embodiment, if the concentrations of Nd, Pr, Dy and Tb are identified by $M_{Nd}$, $M_{Pr}$, $M_{Dy}$ and $M_{Tb}$ (at %), respectively, and satisfy the equations $B_{Nd}+M_{PR}=M_{RL}$, $M_{Dy}+M_{Tb}=M_{RH}$ and $M_{RL}\alpha M_{RH}M_R$, then the c-axis length Lc (Å) of the main phase satisfies, in the portion where the two peaks of diffraction are observed, the inequalities: $Lc \geqq 12.05$, and $Lc+(0.18-0.05\times M_{Tb}/M_{RH})\times M_{RH}/M_R-0.03\times M_{Pr}/M_{RL} \leqq 12.18$ (where $0<M_{RH}/M_R \leqq 0.4$).

Effects of the Invention

According to the present invention, the magnet includes a portion in which at least two peaks of diffraction are observed within a 2θ range of 60.5 degrees to 61.5 degrees when an X-ray diffraction measurement is carried out using a CuK a ray on a plane that is located at a depth of 500 μm or less under the surface (i.e., a pole face) of the sintered body and that is parallel to the pole face. Those two peaks indicate the presence of two regions in which the heavy rare-earth element RH has distinctly different concentrations. If those two peaks are observed in a relatively shallow region under the surface of the sintered body (i.e., in a surface region), then it means that there are a portion including a heavy rare-earth element RH in a relatively high concentration (corresponding to the outer periphery of a main phase grain) and a portion including the heavy rare-earth element RH in a relatively low concentration (corresponding to the core of the main phase grain) within each main phase. By realizing such a structure, the magnetocrystalline anisotropy can be increased preferentially in the outer periphery of the main phase grain and the coercivity $H_{cJ}$ can be increased as a result. That is to say, since a layer including RH in an increased concentration can be formed in the outer periphery of the main phase grain by using just a small amount of heavy rare-earth element RH, the decrease in remanence $B_r$ can be minimized and the coercivity $H_{cJ}$ can be increased.

BRIEF DESCRIPTION OF DRAWINGS

FIG. 3(*b*) is a graph illustrating the peak of diffraction representing the (008) plane of a comparative example on a larger scale. And FIG. 3(*c*) is a graph illustrating the peak of diffraction representing the (008) plane of another comparative example on a larger scale.

FIG. 4(*b*) is a graph showing a relation (range) between the c-axis length and the Dy concentration in a preferred embodiment of the present invention.

DESCRIPTION OF REFERENCE NUMERALS

| | |
|---|---|
| 2 | sintered magnet body |
| 4 | RH bulk body |
| 6 | processing chamber |
| 8 | net made of Nb |

BEST MODE FOR CARRYING OUT THE INVENTION

An R—Fe—B based anisotropic sintered magnet according to the present invention has, as a main phase, an $R_2Fe_{14}B$ type compound that includes a light rare-earth element RL (which is at least one of Nd and Pr) as a major rare-earth element R, and also has a heavy rare-earth element RH (which is at least one element selected from the group consisting of Dy and Tb). Also, in the R—Fe—B based anisotropic sintered magnet of the present invention, the easy magnetization axis (i.e., c-axis) of the main phase has an orientation, and the surface of the sintered body that intersects with the orientation direction substantially at right angles functions as a pole face. The present invention is characterized in that a portion in which at least two peaks of diffraction are observed within a 2θ range of 60.5 degrees to 61.5 degrees when an X-ray diffraction measurement is carried out by 2θ method using a CuK α ray is included in a plane that is located at a depth of 500 μm or less under a pole face of the magnet and that is parallel to the pole face.

The R—Fe—B based anisotropic sintered magnet of the present invention has a structure in which the heavy rare-earth element RH has been diffused inside an R—Fe—B based anisotropic sintered magnet body through the surface thereof and which is preferably obtained by a diffusion process that advances the grain boundary diffusion more preferentially than the intragrain diffusion, for example. As used herein, the "intragrain diffusion" means diffusion inside a main phase crystal grain, while the "grain boundary diffusion" means diffusion through grain boundary phases such as R-rich phases. The heavy rare-earth element RH does not have to be diffused through the entire surface of the sintered body but may also be diffused through just a part of the surface. If the diffusion occurred only in a particularly part of the sintered magnet body, then the portion in which at least two peaks of diffraction are observed within the 2θ range of 60.5 to 61.5 degrees by X-ray diffraction measurement would form only part of a plane that is parallel to the pole face.

The coercivity does not have to be increased in the entire sintered magnet body but could be increased only in a particular portion of the sintered magnet body according to the intended application. That portion in which at least two peaks of diffraction are observed within the 2θ range of 60.5 to 61.5 degrees by X-ray diffraction measurement has an area of 1 $mm^2$ or more on a plane that is parallel to the pole face.

First of all, the crystal structure of the R—Fe—B based anisotropic sintered magnet of the present invention will be described in detail with reference to FIGS. 1 through 3.

Figure 1:
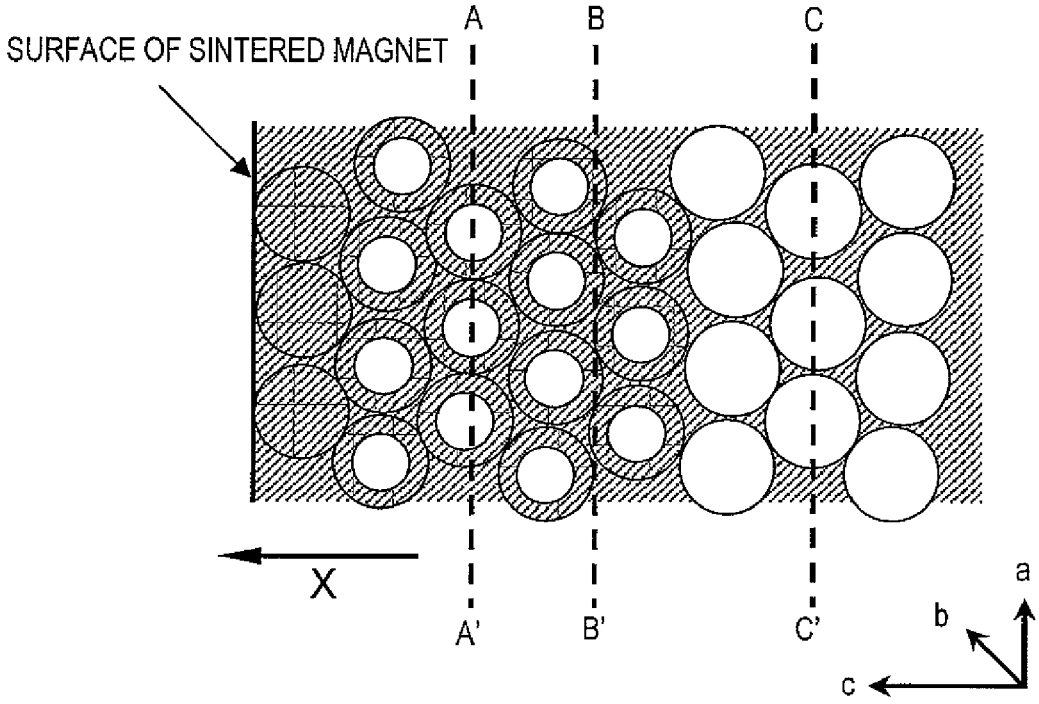
FIG. 1 is a cross-sectional view schematically illustrating the structure of an R—Fe—B based anisotropic sintered magnet according to the present invention near the surface thereof.

FIG. 1 is a cross-sectional view schematically illustrating the structure of an R—Fe—B based anisotropic sintered magnet according to the present invention near the surface thereof. The magnet shown in FIG. 1 is an R—Fe—B based anisotropic sintered magnet in which a heavy rare-earth element RH has been diffused inside a sintered body through the surface thereof under such conditions that grain boundary diffusion advances more rapidly than intragrain diffusion does. FIG. 1 shows the c-axis, which is the easy magnetization axis of the $R_2Fe_{14}B$ type compound that is the main phase, and a- and b-axes, which cross the c-axis at right angles and which intersect with each other at right angles. According to the present invention, in each gain of the $R_2Fe_{14}B$ type compound, the c-axis is oriented in the direction indicated by the arrow X. The surface of the sintered body illustrated in FIG. 1 corresponds to the pole face and intersects with that orientation direction substantially at right angles. Such a plane that intersects with the c-axis at right angles is generally called a "c-plane". Thus, the pole face is substantially parallel to the c-plane.

In FIG. 1, the circles represent crystal grains of the $R_2Fe_{14}B$ type compound that is the main phase and the shadow indicates the region in which the heavy rare-earth element RH has been diffused. In the example illustrated in FIG. 1, the heavy rare-earth element RH has been diffused from the pole face on the left-hand side toward the inner portion of the sintered body on the right-hand side mainly through the grain boundary. Also, in the vicinity of the surface of the magnet, the heavy rare-earth element RH has had its concentration increased only in the outer periphery of the main phases and does not reach the core of the main phases. Therefore, each main phase crystal grain includes the heavy rare-earth element RH in the outer periphery and core thereof in mutually different concentrations and has a main phase lattice constant corresponding to that concentration. In an $R_2Fe_{14}B$ type compound, if the light rare-earth element RL that is its major rare-earth element R is partially replaced with the heavy rare-earth element RH, then the c-axis of the crystal will shrink significantly, and therefore, it can be estimated, by measuring the c-axis length, how much RL has been replaced with RH in the main phase. Both of the planes AA' and BB' shown in FIG. 1 are located at depths of less than 500 μm under the pole face and are parallel to the pole face. On the other hand, the plane CC' shown in FIG. 1 is also parallel to the pole face but is located at a depth of more than 500 μm under the surface of the sintered body.

Figure 2:
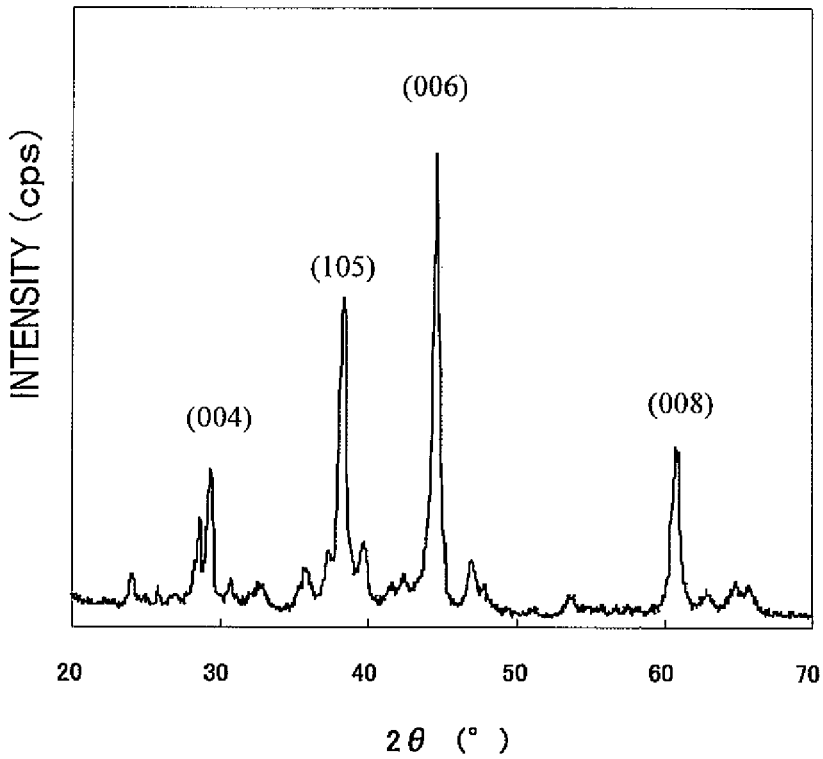
FIG. 2 is a graph showing the results of an X-ray diffraction measurement that was carried out on the plane AA' shown in FIG. 1.

FIG. 2 is a graph showing the results of an X-ray diffraction measurement that was carried out on the plane AA' shown in FIG. 1 by θ-2θ method. The results shown in FIG. 1 were obtained by carrying out an X-ray diffraction measurement on the plane AA' shown in FIG. 1 using a CuK α ray after the plane AA' had been exposed by polishing and removing the pole face of the sintered magnet shown in FIG. 1. And the data shown in FIG. 1 was collected in the 2θ range of 20 to 70 degrees.

As can be seen from FIG. 2, intense peaks of diffraction representing the (004), (006) and (008) planes of the main phase crystal grains were observed, and therefore, the main phase crystal grains would have been oriented in the c-axis direction corresponding to the easy magnetization axis of the main phases. FIG. 3(*a*) is a graph illustrating the peak of diffraction representing the (008) plane shown in FIG. 2 on a larger scale. As can be seen easily from FIG. 3(*a*), two peaks were observed within the 2θ range of 60.5 to 61.5 degrees. These results were obtained because there should have been two regions including the heavy rare-earth element RH in distinctly different concentrations within each main phase as shown in FIG. 1. For example, at the depth of the plane AA' shown in FIG. 1, the plane AA' intersects with both a portion of each main phase where Dy has been diffused and the other portion of the main phase where Dy has not been diffused. Since the X-ray diffraction detection area had a size of at least 1 $mm^2$, for example, there should have been a huge number of main phase crystal grains within that diffraction area. Of those two peaks of diffraction representing the (008) plane as observed in the diffraction data, one of the two peaks of diffraction that has the greater 2θ would have been produced by the outer periphery of the main phases (i.e., RH concentrated region), while the other peak of diffraction that has the smaller 2θ would have been produced by the core of the main phases (i.e., RH non-diffused region). In this case, the greater 2θ, the narrower the interplanar spacing d, and therefore, the shorter the c-axis length. Also, the higher the RH concentration, the shorter the c-axis length of a crystal would be. If the light rare-earth element RL of a main phase is replaced with the heavy rare-earth element RH, then the main phase comes to have a shorter c-axis length. It should be noted that if the concentration of the heavy rare-earth element RH had had a continuous distribution within the main phases, then the c-axis length would also have had a continuous distribution. In that case, the peak of diffraction indicating the presence of the (008) plane would have been broadened and should not have had two or more separate peaks.

Such two or more separate peaks of diffraction, indicating the presence of multiple regions with mutually different c-axis lengths, are not observed often in the (004) and (006) planes but are observed quite often in the (008) plane. This is because in the (008) plane, peaks of diffraction appear at greater 2θ, and the resolution of the X-ray diffraction becomes higher, than in the (004) or (006) plane.

The magnet illustrated in FIG. 1 is supposed to have a rectangular cross section and a c-plane that is oriented substantially parallel to the pole face for the sake of simplicity. However, in a magnet with a special orientation, which may be a magnet with radial anisotropy or polar anisotropy or a rectangular magnet with concentrated orientation, the c-plane is not always substantially parallel to the pole face. Even so, as long as the given plane is parallel to the pole face, a relatively intense peak of diffraction, indicating the presence of a c-plane, can still be observed by X-ray diffraction measurement, and therefore, the evaluation can also be done as in the examples shown in FIGS. 2 and 3.

It should be noted that the plane BB' shown in FIG. 1 crosses only a region in which the heavy rare-earth element RH has diffused. That is why even if an X-ray diffraction measurement were carried out on the plane BB', almost no peaks of diffraction, indicating the presence of such a non-diffused portion, would appear within the 2θ range of 60.5 to 61.5 degrees. Consequently, even in a sintered magnet in which the grain boundary diffusion has been advanced preferentially, only one peak of diffraction will be observed within the 2θ range of 60.5 to 61.5 degrees as for the plane BB'. In this manner, in such a region at a depth of 500 μm or less under the pole face, within the 2θ range of 60.5 to 61.5 degrees, two peaks of diffraction are not always observed but just one peak of diffraction could sometimes be observed. One of the key features of the present invention is that a plane such as the plane AA' shown in FIG. 1 is observed within a region that is located at a depth of 500 μm or less (typically at a depth of 200 μm) under the surface of the sintered body.

As described above, in an R—Fe—B based anisotropic sintered magnet, the heavy rare-earth element RH distributed in the outer periphery of its main phase grain (i.e., in the vicinity of the grain boundary) would certainly contribute to increasing the coercivity. In that portion with the increased RH concentration, the coercivity has certainly been increased significantly due to the improvement of the magnetocrystalline anisotropy but the remanence $B_r$ would decrease because the magnetic moment of the heavy rare-earth element RH and that of Fe have mutually opposite directions. That is why the overall remanence ($B_r$) of the resultant magnet would somewhat decrease, too.

If the R—Fe—B based anisotropic sintered magnet has such a crystal structure as the one shown in FIG. 1 in which the heavy rare-earth element RH diffused has not reached the core of the main phases in the vicinity of the surface of the sintered body, the coercivity $H_{cJ}$ can be increased effectively with the decrease in remanence $B_r$ minimized. In addition, the amount of the heavy rare-earth element RH required can be reduced, too.

On the other hand, in an R—Fe—B based anisotropic sintered magnet (as a comparative example) in which a heavy rare-earth element RH has been diffused by a method in which the grain boundary diffusion would not advance more rapidly than the intragrain diffusion (e.g., by a process in which a coating of the heavy rare-earth element RH is deposited and then the heavy rare-earth element RH is diffused), the heavy rare-earth element RH diffused would reach the core of the main phases in the vicinity of the surface, and therefore, it is difficult to obtain the crystal structure shown in FIG. 1. In that case, if an X-ray diffraction measurement were carried out on a plane that intersects with the c-axis within a region that is located at a depth of 500 μm or less under the pole face, two or more peaks of diffraction would never be observed within the 2θ range of 60.5 to 61.5 degrees.

Figure 3A:
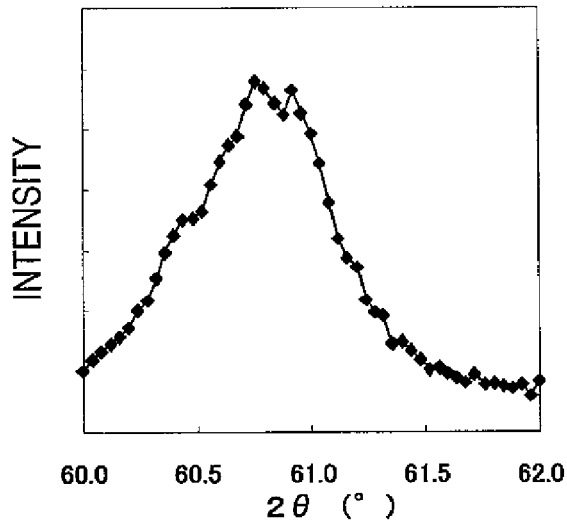
FIG. 3(*a*) is a graph illustrating the peak of diffraction representing the (008) plane shown in FIG. 2 on a larger scale.
Figure 3B:
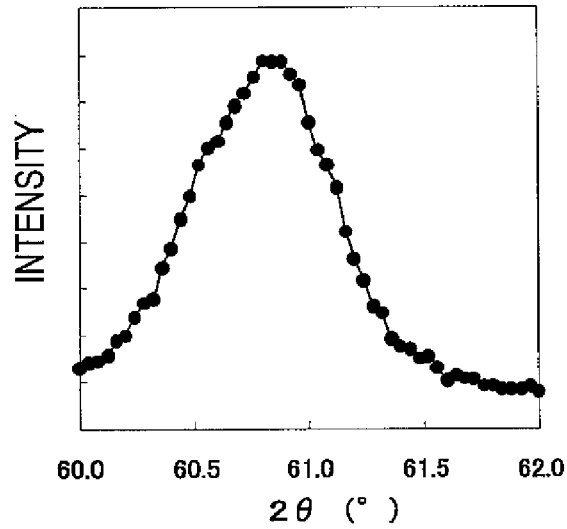
Figure 3C:
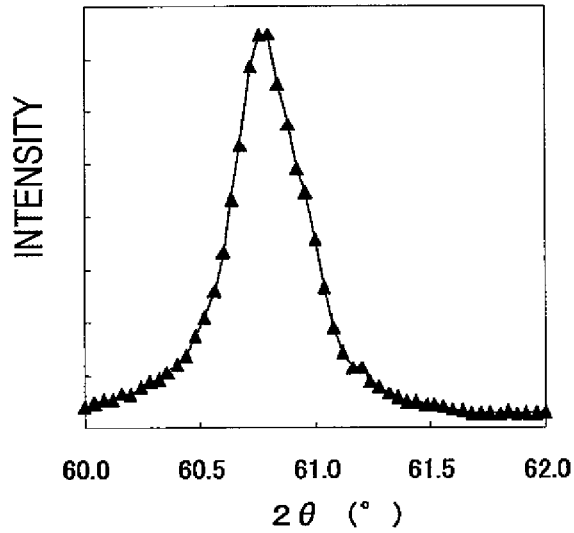

FIG. 3(*b*) is a graph showing the results of an X-ray diffraction measurement that was carried out on a plane parallel to the pole face as a comparative example. Specifically, in this comparative example, a sample in which a Dy film had been deposited on the surface of a sintered magnet body and then Dy had been diffused inside the sintered magnet body from the Dy film was provided and the X-ray diffraction measurement was carried out on a plane that was located at a depth of 40 μm under the surface of that sample sintered magnet body. And the results of that measurement are shown in FIG. 3(*b*). As can be seen from FIG. 3(*b*), only one broad peak of diffraction was observed in the 2θ range of 60.5 to 61.5 degrees. In this comparative example, the heavy rare-earth element RH would have diffused to reach not only the grain boundary but also the core of the main phase grain as well, and the concentration of the heavy rare-earth element RH would have varied continuously in the region where it diffused. If the heavy rare-earth element RH diffused and reached the core of the main phase grain in this manner, the magnitude of increase in $H_{cJ}$ would be too small for the amount of the heavy rare-earth element RH added or the magnitude of decrease in remanence $B_r$. That is to say, the heavy rare-earth element RH would be wasted in vain.

A technique for increasing the Dy concentration in the outer periphery of main phases rather than at the core thereof by blending together two different kinds of alloy powders including a heavy rare-earth element RH in mutually different concentrations and by causing Dy to diffuse from powder particles with the higher Dy concentration toward powder particles with the lower Dy concentration during a sintering process (which is called a "two-alloy blending method") is known. According to the two-alloy blending method, however, those powder particles with mutually different Dy concentrations would form one big particle and Dy would diffuse inside that big particle. As a result, the concentration of the heavy rare-earth element RH would vary gently inside the main phase crystal grains and no range with a distinctly different Dy concentration would be identified. Particularly since the sintering process is normally carried out at as high a temperature as 1,000° C. to 1,200° C., Dy would produce significant intragrain diffusion during the sintering process. Consequently, according to the two-alloy blending method, the structure that the surface region shown in FIG. 1 has cannot be obtained. FIG. 3(*c*) is a graph showing the results of an X-ray diffraction measurement that was carried out on a sintered magnet made by the two-alloy blending method as another comparative example. As can be seen from FIG. 3(*c*), only one peak of diffraction was observed even according to the two-alloy blending method.

The c-axis length of the main phase grains can be obtained based on the results of an X-ray diffraction shown in FIG. 2. Specifically, using the results of the X-ray diffraction measurement, an angle of diffraction θ may be calculated based on the peaks of diffraction indicating the presence of the (004), (006) and (008) planes, for example, and the interplanar spacing value d between the c-planes of the main phases can be calculated. If there are two peaks of diffraction indicating the presence of the (008) plane, then there will be two interplanar spacing values d for the two peaks of diffraction. In that case, one of the two interplanar spacing values d that is associated with the peak of diffraction having the greater 2θ value may be chosen.

If the d values of the (004), (006) and (008) planes are identified by d(004), d(006) and d(008), respectively, the average c-axis length of the main phase grains can be represented by the following Equation (1):

$$c\text{-axis length} = \frac{d(004)\times 4 + d(006)\times 6 + d(008)\times 8}{3} \quad (1)$$

Figure 4A:
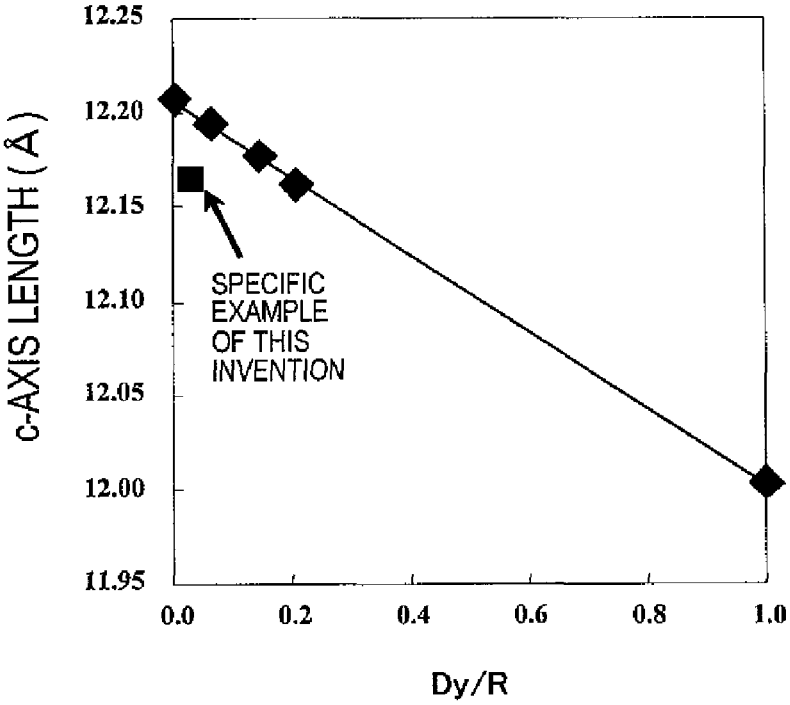
FIG. 4(*a*) is a graph showing how the c-axis length (Å) changed with the concentration of a heavy rare-earth element RH.
Figure 4B:
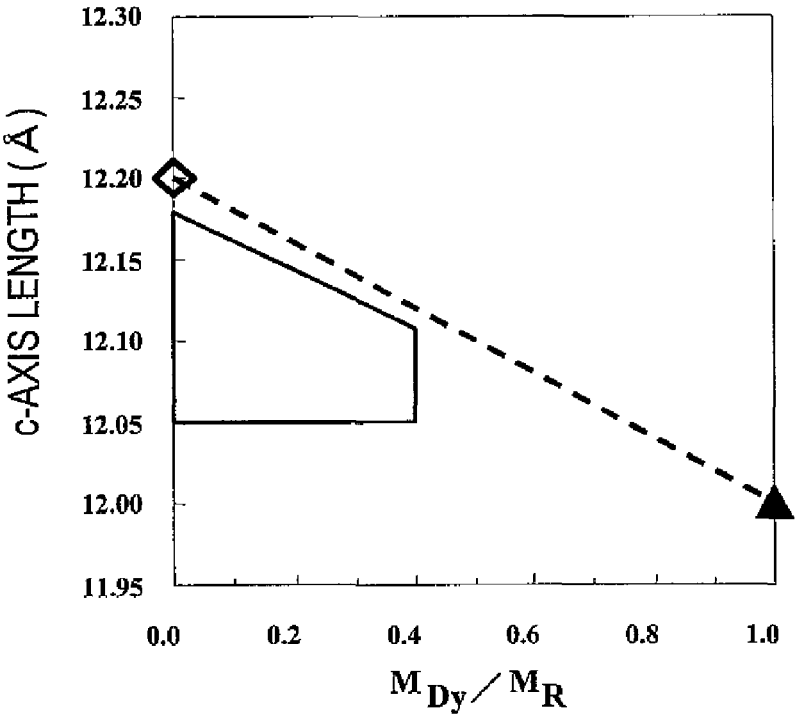

FIG. 4(*a*) is a graph showing how the c-axis length (Å) changed with the concentration of the heavy rare-earth element RH. In FIG. 4(*a*), only Nd and Dy were supposed to be included as rare-earth elements for the sake of simplicity. In FIG. 4(*a*), the abscissa represents the value obtained by dividing the concentration of Dy (at %) by the sum of the concentrations of rare-earth elements R (at %). That is to say, the sum of R concentrations is the sum of the concentrations of Nd and Dy in this case. On the other hand, the ordinate represents the c-axis length (Å), which was calculated by substituting d(004), d(006) and d(008) that had been obtained by the X-ray diffraction measurement into Equation (1).

To collect the data shown in FIG. 4(*a*), Nd—Dy—Fe—B based sintered magnets with mutually different Dy concentrations were made as comparative examples from a material alloy, to which Dy had been added uniformly, and the c-axis lengths of the main phases were measured. Meanwhile, an Nd—Fe—B based sintered magnet, in which Dy was diffused inside an Nd—Fe—B based sintered magnet body that had been made from a material alloy with no Dy through its surface and in which Dy had a concentration of 0.4 at %, was prepared as a specific example of the present invention. And the c-axis length was measured in the outer periphery of the main phase grain at a depth of 80 μm under the surface of the sintered body (i.e., in the RH diffused region). In the specific example of the present invention, Dy was diffused so that its grain boundary diffusion advanced more rapidly than its intragrain diffusion.

In FIG. 4(*a*), the c-axis lengths of the comparative examples with mutually different Dy concentrations are indicated by solid diamonds ♦ and the c-axis length of the specific example of the present invention (with a Dy concentration of 0.4 at %) is indicated by the solid square ■. In FIG. 4(*a*), the c-axis lengths of the comparative examples can be approximated by the following linear equation (2):

$$y=-0.2x+12.20 \quad (2)$$

where y represents the c-axis length (Å) and x represents Dy/R.

As can be seen, there is a linear relation between the Dy concentration and the c-axis length (i.e., as the Dy concentration increases, the c-axis length decreases). Such a linear relation is also satisfied even when a rare-earth element such as Pr or Tb is added.

In the specific example of the present invention, on the other hand, even though the RH (Dy) concentration of the entire sintered magnet was as low as 0.4 at % (and Dy/R was just 0.028), the c-axis length was still shorter than those of the comparative examples as shown in FIG. 4(*a*). This means that by increasing the concentration of the heavy rare-earth element RH (i.e., Dy in this case) in the outer periphery of the main phase grain, the c-axis length could be shortened effectively even with a relatively small amount of Dy added.

Thus, it can be seen that in a sintered magnet into which Dy had been introduced as an additional heavy rare-earth element RH through the surface thereof so that the grain boundary diffusion would advance preferentially, the heavy rare-earth element RH (Dy) had had its concentration increased more efficiently in the outer periphery of the main phase grain than in the comparative examples described above. The present inventors also discovered that the coercivity $H_{cJ}$ of this specific example of the present invention was higher than those of the comparative examples, although the same amount of Dy had been added to both the specific example of the present invention and the comparative examples. In other words, according to the present invention, the amount of the heavy rare-earth element RH (Dy) that needs to be added to achieve the coercivity $H_{cJ}$ required can be reduced compared to the conventional magnets.

The present inventors further looked into the relation between the c-axis length of the RH diffused region and the resultant magnetic properties. As a result, the present inventors discovered that if the c-axis length of the main phase crystal lattice and the concentrations of the rare-earth elements satisfied a predetermined relation, good magnetic properties (in terms of coercivity $H_{cJ}$, among other things) were achieved. Suppose the main phases that are located in the surface region (i.e., a region at a depth of 500 μm or less under the pole face) have a c-axis length of Lc (Å) and the concentrations of Nd, Pr, Dy and Tb are identified by $M_{Nd}$, $M_{Pr}$, $M_{Dy}$ and $M_{Tb}$ (at %), respectively. In this case, $M_{Pr}\geqq 0$, $M_{Dy}\geqq 0$ and $Mr_{Tb}\geqq 0$ but $M_{Dy}+M_{Tb}>0$. That is to say, the concentrations of the respective elements Pr, Dy and Tb could be equal to zero but not both of the Dy and Tb concentrations can be equal to zero.

Also, $M_{RL}$, $M_{RH}$ and $M_R$ are defined so as to satisfy the following equations:

$$M_{Nd}+M_{Pr}=M_{RL},$$

$$M_{Dy}+M_{Tb}=M_{RH}, \text{ and}$$

$$M_{RL}+M_{RH}=M_R,$$

In that case, if there is any region that satisfies:

$$Lc\geqq 12.05, \text{ and}$$

$$Lc+(0.18-0.05\times M_{Tb}/M_{RH})\times M_{RH}/M_R-0.03\times M_{Pr}/M_{RL}\leqq 12.18 \text{ (where } 0<M_{RH}/M_R\leqq 0.4).$$

then particularly high coercivity $H_{cJ}$, will be achieved even when $M_{RH}$ is small.

FIG. 4(*b*) is a graph showing the trapezoidal range to be defined by these inequalities in a situation where $M_{Pr}=0$ and $M_{Tb}=0$. In FIG. 4(*b*), the oblique dashed line represents the relation between the c-axis length and $M_{Dy}/M_R$ in the R—Fe—B based sintered magnet as a comparative example.

Hereinafter, the range defined by those inequalities will be described with reference to FIG. 4(*b*).

First of all, it will be described what the inequality $0<M_{RH}/M_R\leqq 0.4$ means. As described above, the higher the percentage of the overall rare-earth element R replaced with the heavy rare-earth element RH, the greater the coercivity $H_{cJ}$. However, if too large a percentage of the rare-earth element R were replaced with the heavy rare-earth element RH, the effect of increasing the coercivity $H_{cJ}$ would get saturated. That is why the ratio of the concentration of the heavy rare-earth element RH to the sum of the concentrations of the rare-earth elements R is preferably equal to or smaller than 0.4.

Next, it will be described what the inequality Lc 12.05 means.

The present inventors tentatively tried to increase the coercivity $H_{cJ}$ by diffusing the heavy rare-earth element RH a lot through the surface of a sintered magnet body and forming an RH diffused region, including RH in a high concentration, in the outer periphery of the main phase grain in the surface region. As a result, we discovered that even when a lot of RH diffused, the concentration of RH in the RH diffused region did not increase beyond a certain level and the coercivity $H_{cJ}$ did not increase, either. Also, when the effect of increasing the coercivity $H_{cJ}$ got saturated, the c-axis length in the RH diffused region was not a constant value. But in the range that satisfied $0<M_{RH}/M_R\leqq 0.4$, the lower limit of the c-axis length was 12.05 Å.

Next, it will be described what the inequality $Lc+(0.18-0.05\times M_{Tb}/N_{RH}\times M_{RH}/M_R-0.03\times M_{Pr}/M_{RL}\leqq 12.18$ means.

As described above, in the conventional sintered magnet, the relation between the c-axis length and the heavy rare-earth element RH can be approximated by the linear equation $y=-0.2x+12.20$. On the other hand, in the structure in which the heavy rare-earth element RH has been diffused through the surface of a sintered magnet body and has had its concentration increased efficiently in the outer periphery of the main phase grain to increase the coercivity $H_{cJ}$ as in the present invention, even if the amount of RH (represented by the RH ratio $M_{RH}/M_R$ is the same, the c-axis length thereof becomes shorter than that of the conventional sintered magnet. The present inventors discovered and confirmed via experiments that the difference in c-axis length from the example of the prior art is at least 0.01 Å, and more preferably 0.02 Å or more. We discovered that the upper limit of the c-axis length in a situation where $M_{Pr}=0$ and $M_{Tb}=0$ could be linearly approximated by $y=-0.18x+12.18$.

The reason why the gradient of −0.2 of the line of the conventional magnet and the gradient of −0.18 of the specific example of the present invention are different from each other is that their y intercepts (where $M_{RH}/M_R=0$) are different from each other but that their c-axis lengths will be approximately the same when the rare-earth elements R are entirely replaced with the heavy rare-earth element RH (i.e., when $M_{RH}/M_R=1$).

For these reasons, the c-axis length in a surface region where there are those two peaks satisfies the inequalities described above.

Furthermore, the present inventors investigated into the depth of a region where the c-axis length shortened.

Figure 5:
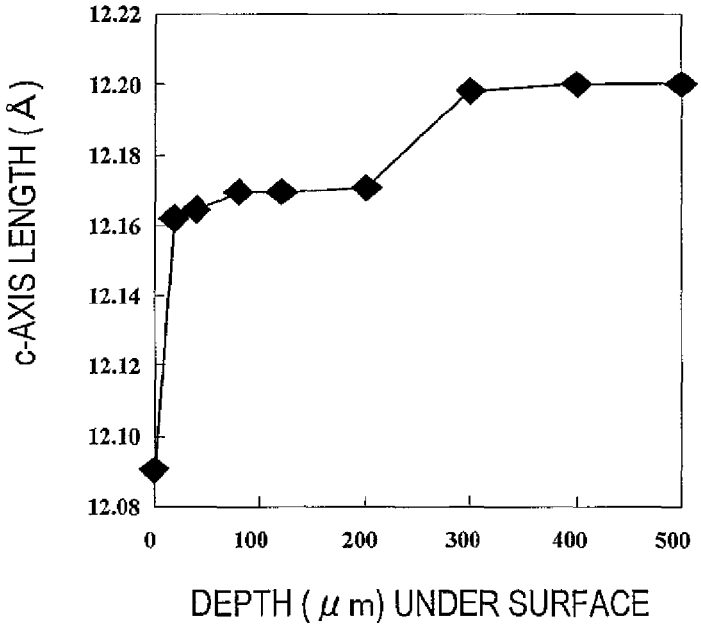
FIG. 5 is a graph showing the relation between the depth under the surface of a sintered body as a specific example of the present invention and the c-axis length.

FIG. 5 is a graph showing the relation between the depth under the surface of a sintered magnet as a specific example of the present invention and the c-axis length of the main phase grains at that depth. By polishing and removing, to various depths, the surface portion of the sample that had been prepared to measure the c-axis length of the specific example shown in FIG. 4(*a*), an X-ray diffraction measurement was sequentially carried out at those different depths under the surface of the sintered magnet to measure the c-axis lengths there.

As can be seen from FIG. 5, at the surface of the sintered magnet (i.e., at a depth of 0 μm), the c-axis length was rather short, and therefore, the heavy rare-earth element RH would have had its concentration increased sufficiently there. On the other hand, it can also be seen that in the depth range of approximately 10 μm to approximately 200 μm under the surface of the sintered magnet, the c-axis length hardly changed. Such a range would correspond to the region where the heavy rare-earth element RH failed to reach the core of the main phase grain but had its concentration increased in its outer periphery.

In the region that was located at a depth of 200 μm or less under the surface of the sintered magnet, there was a portion where two peaks indicating the presence of a (008) plane were observed within the 2θ range of 60.5 to 61.5 degrees as a result of an X-ray diffraction measurement using a CuK α ray. According to the site irradiated with a CuK α ray, just one peak was sometimes observed. That result was obtained probably because a plane corresponding to the plane BB' shown in FIG. 1 would have been observed.

As for the sample used in this example, its c-axis length increased from a depth of approximately 200 μm to a depth of approximately 300 μm under the surface of the sintered magnet but substantially stopped changing at a depth of approximately 300 μm. Thus, in this sample, almost no Dy would have entered the main phases by diffusion at a depth of 300 μm or more and the plane CC' shown in FIG. 1 would have been observed there.

However, when the magnet performance was evaluated on such a region at a depth of more than 200 μm, an increase in coercivity $H_{cJ}$ was confirmed. This result reveals that just a small amount of Dy would have diffused and entered the main phases even at such a depth of more than 200 μm and contributed to increasing the coercivity.

In the example shown in FIG. 5, the increase in c-axis length started to be sensed at a depth of 200 μm. However, that depth will vary according to the diffusion process conditions such as the process time and temperature. For example, if the diffusion process is carried out for an extended amount of time, the c-axis length can keep varying up to a depth of 500 μm. However, if the process conditions were defined so that the maximum depth will exceed 500 μm, then the process time would be too long to avoid consuming a lot of the heavy rare-earth element RH diffused and to improve the properties more significantly than a situation where the depth is 500 μm or less. That is why the effective depth is 500 μm or less.

According to the present invention, any method for introducing a heavy rare-earth element RH into a sintered magnet body by diffusion may be adopted as long as the grain boundary diffusion can advance preferentially, but the evaporation diffusion process to be described below may be adopted, for example. The evaporation diffusion process is particularly preferred for the following reasons. Specifically, according to the evaporation diffusion process, the intragrain diffusion hardly occurs in a surface region of the sintered magnet body, and only a small amount of heavy rare-earth element RH will get deposited on the wall surface of a deposition system and wasted in vain. Consequently, the evaporation diffusion process can be carried out at a reduced cost, which is advantageous.

Hereinafter, the evaporation diffusion process will be described in detail.

In the evaporation diffusion process, a bulk body of a heavy rare-earth element RH that is not easily vaporizable (or sublimable) and a rare-earth sintered magnet body are arranged close to each other in the processing chamber and both heated to a temperature of 700° C. to 1,100° C., thereby reducing the vaporization (or sublimation) of the RH bulk body to the point that the growth rate of an RH film is not excessively higher than the rate of diffusion of RH into the sintered magnet body and diffusing the heavy rare-earth element RH, which has traveled to reach the surface of the sintered magnet body, into the sintered magnet body quickly. At such a temperature falling within the range of 700° C. to 1,100° C., the heavy rare-earth element RH hardly vaporizes (or sublimes) but the rare-earth element diffuses actively in an R—Fe—B based rare-earth sintered magnet body with the grain boundary phases. For that reason, the grain boundary diffusion of the heavy rare-earth element RH into the magnet body can be accelerated more sharply than the film formation of the heavy rare-earth element RH on the surface of the magnet body.

According to the evaporation diffusion process, the heavy rare-earth element RH will diffuse and penetrate through the grain boundary into the magnet at a higher rate than the heavy rare-earth element RH diffusing into the main phases that are located near the surface of the sintered magnet body.

In the prior art, it has been believed that to vaporize (or sublime) a heavy rare-earth element RH such as Dy, the magnet body should be heated to a temperature exceeding 1,200° C. and that it would be impossible to deposit Dy on the surface of the sintered magnet body just by heating it to a temperature as low as 700° C. to 1,200° C. because the saturation vapor pressure of Dy (which is about 1 Pa) is approximately a $100{,}000^{th}$ or less of the atmospheric pressure at that temperature. Contrary to this popular belief, however, the results of experiments the present inventors carried out revealed that the heavy rare-earth element RH could still be supplied onto an opposing rare-earth magnet body and diffused into it even at such a low temperature of 700° C. to 1,100° C.

According to the conventional technique of forming a film of a heavy rare-earth element RH (which will be referred to herein as an "RH film") on the surface of a sintered magnet body and then diffusing the element into the sintered magnet body by heat treatment process, so-called "intragrain diffusion" will advance significantly in the surface region of the magnet body that is in contact with the RH film (because their concentrations are quite different from each other), thus decreasing the remanence of the magnet. On the other hand, according to the evaporation diffusion process, since the heavy rare-earth element RH is supplied onto the surface of the sintered magnet body with the growth rate of the RH film decreased and the temperature of the sintered magnet body is maintained at an appropriate level for diffusion, the heavy rare-earth element RH that has reached the surface of the magnet body quickly penetrates into the sintered magnet body by grain boundary diffusion. In this case, since the RH element has a relatively low concentration in the grain boundary phases, the RH element will not diffuse so much into the main phase crystal grains. That is why even in the surface region of the magnet body, the "grain boundary diffusion" advances more preferentially than the "intragrain diffusion" and the outer periphery of the main phase grain, in which the RH element has had its concentration increased, still has a small thickness. As a result, the decrease in remanence $B_r$ can be minimized and the coercivity $H_{cJ}$ can be increased effectively.

The R—Fe—B based anisotropic sintered magnet has a nucleation type coercivity generating mechanism. Therefore, if the magnetocrystalline anisotropy is increased in the outer periphery of a main phase, the nucleation of reverse magnetic domains can be reduced in the outer periphery of the main phase grain. As a result, the coercivity $H_{cJ}$ of the main phase can be increased effectively as a whole. According to the evaporation diffusion process, the heavy rare-earth replacement layer can be formed in the outer periphery of the main phase not only in a surface region of the sintered magnet body but also deep inside the sintered magnet body. Consequently, the coercivity $H_{cJ}$ of the overall sintered magnet body increases sufficiently.

Considering the facility of evaporation diffusion, the cost and other factors, it is most preferable to use Dy as the heavy rare-earth element RH that replaces the light rare-earth element RL in the outer periphery of the main phase. However, the magnetocrystalline anisotropy of $Tb_2Fe_{14}B$ is higher than that of $Dy_2Fe_{14}B$ and is about three times as high as that of $Nd_2Fe_{14}B$. That is why if Tb is evaporated and diffused, the coercivity can be increased most efficiently without decreasing the remanence of the sintered magnet body. When Tb is used, the evaporation diffusion is preferably carried out at a higher temperature and in a higher vacuum than a situation where Dy is used because Tb has a lower saturation vapor pressure than Dy.

As can be seen easily from the foregoing description, according to the present invention, the heavy rare-earth element RH does not always have to be added to the material alloy. That is to say, a known R—Fe—B based rare-earth sintered magnet, including a light rare-earth element RL (which is at least one of Nd and Pr) as the rare-earth element R, may be provided and then the heavy rare-earth element RH may be diffused inward from the surface of the magnet. If only a conventional layer of a heavy rare-earth element RH were formed on the surface of the magnet, it would be difficult to diffuse the heavy rare-earth element RH deep inside the magnet, while controlling its diffusion into the main phase, even at an elevated diffusion temperature. However, according to the present invention, by producing the grain boundary diffusion of the heavy rare-earth element RH, the heavy rare-earth element RH can be supplied efficiently to even the outer periphery of the main phases that are located deep inside the sintered magnet body. The present invention is naturally applicable to an R—Fe—B based anisotropic sintered magnet, to which the heavy rare-earth element RH was already added when it was a material alloy. However, if a lot of heavy rare-earth element RH were added to the material alloy, the effect of the present invention would not be achieved sufficiently. For that reason, a relatively small amount of heavy rare-earth element RH may be added in that early stage.

Next, an example of a preferred evaporation diffusion process will be described with reference to FIG. 6, which illustrates an exemplary arrangement of sintered magnet bodies 2 and RH bulk bodies 4. In the example illustrated in FIG. 6, the sintered magnet bodies 2 and the RH bulk bodies 4 are arranged so as to face each other with a predetermined gap left between them inside a processing chamber 6 made of a refractory metal. The processing chamber 6 shown in FIG. 6 includes a member for holding a plurality of sintered magnet bodies 2 and a member for holding the RH bulk body 4. Specifically, in the example shown in FIG. 6, the sintered magnet bodies 2 and the upper RH bulk body 4 are held on a net 8 made of Nb. However, the sintered magnet bodies 2 and the RH bulk bodies 4 do not have to be held in this way but may also be held using any other member. Nevertheless, a member that closes the gap between the sintered magnet bodies 2 and the RH bulk bodies 4 should not be used. As used herein, "facing" means that the sintered magnet bodies and the RH bulk bodies are opposed to each other without having their gap closed. Also, even if two members are arranged "so as to face each other", it does not necessarily mean that those two members are arranged such that their principal surfaces are parallel to each other.

By heating the processing chamber 6 with a heater (not shown), the temperature of the processing chamber 6 is raised. In this case, the temperature of the processing chamber 6 is controlled to the range of 700° C. to 1,100° C., more preferably to the range of 850° C. to 1,000° C., and even more preferably to the range of 850° C. to 950° C. In such a temperature range, the heavy rare-earth element RH has a very low vapor pressure and hardly vaporizes. In the prior art, it has been commonly believed that in such a temperature range, a heavy rare-earth element RH, vaporized from an RH bulk body 4, be unable to be supplied and deposited on the surface of the sintered magnet body 2.

However, the present inventors discovered that by arranging the sintered magnet body 2 and the RH bulk body 4 close to each other, not in contact with each other, a heavy rare-earth element RH could be deposited at as low a rate as several μm per hour (e.g., in the range of 0.5 μm/Hr to 5 μm/Hr) on the surface of the sintered magnet body 2. We also discovered that by controlling the temperature of the sintered magnet body 2 within an appropriate range such that the temperature of the sintered magnet body 2 was equal to or higher than that of the RH bulk body 4, the heavy rare-earth metal RH that had been deposited in vapor phase could be diffused deep into the sintered magnet body 2 as it was. This temperature range is a preferred one in which the heavy rare-earth element RH diffuses inward through the grain boundary phase of the sintered magnet body 2. As a result, slow deposition of heavy rare-earth element RH and quick diffusion thereof into the magnet body can be done efficiently.

According to the evaporation diffusion process, RH that has vaporized just slightly as described above is deposited at a low rate on the surface of the sintered magnet body. For that reason, there is no need to heat the processing chamber to a high temperature or apply a voltage to the sintered magnet body or RH bulk body as in the conventional process of depositing RH by vapor phase deposition.

Also, according to the evaporation diffusion process, with the vaporization and sublimation of the RH bulk body minimized, the heavy rare-earth element RH that has arrived at the surface of the sintered magnet body is quickly diffused inside the magnet body. For that purpose, the RH bulk body and the sintered magnet body preferably both have a temperature falling within the range of 700° C. to 1,100° C.

The gap between the sintered magnet body 2 and the RH bulk body 4 is preferably set to fall within the range of 0.1 mm to 300 mm. This gap is more preferably 1 mm to 50 mm, even more preferably 20 mm or less, and most preferably 10 mm or less. As long as such a distance can be kept between them, the sintered magnet bodies 2 and the RH bulk bodies 4 may be arranged either vertically or horizontally or may even be moved relative to each other. Nevertheless, the distance between the sintered magnet bodies 2 and the RH bulk bodies 4 preferably remains the same during the evaporation diffusion process. Also, an embodiment in which the sintered magnet bodies are contained in a rotating barrel and processed while be stirred up is not preferred. Furthermore, since the vaporized RH can create a uniform RH atmosphere within the distance range defined above, the area of their opposing surfaces is not particularly limited but even their narrowest surfaces may face each other.

In a conventional evaporation system, a good distance should be kept between an evaporating material supply section and the target being processed because a mechanism surrounding the evaporating material supply section would make interference and the evaporating material supply section should be exposed to an electron beam or an ion beam. For that reason, the evaporating material supply section (corresponding to the RH bulk body 4) and the target being processed (corresponding to the sintered magnet body 2) have never been arranged so close to each other as in the evaporation diffusion process. As a result, it has been believed that unless the evaporating material is heated to a rather high temperature and vaporized sufficiently, plenty of the evaporating material could not be supplied onto the target being processed.

In contrast, according to the evaporation diffusion process, the heavy rare-earth element RH can be deposited on the surface of the sintered magnet body just by controlling the temperature of the overall processing chamber without using any special mechanism for vaporizing (or subliming) the evaporating material. As used herein, the "processing chamber" broadly refers to a space in which the sintered magnet bodies 2 and the RH bulk bodies 4 are arranged. Thus, the processing chamber may mean the processing chamber of a heat treatment furnace but may also mean a process vessel housed in such a processing chamber.

Also, according to the evaporation diffusion process, the RH metal vaporizes little but the sintered magnet body and the RH bulk body 4 are arranged close to each other but not in contact with each other. That is why the element RH vaporized can be deposited on the surface of the sintered magnet body efficiently and is hardly deposited on the wall surfaces of the processing chamber because the process is performed in a temperature range in which the element RH has a low vapor pressure. Furthermore, if the wall surfaces of the processing chamber are made of a heat-resistant alloy including Nb, for example, a ceramic, or any other material that does not react to RH, then the heavy rare-earth element RH deposited on the wall surfaces will vaporize again and will be deposited on the surface of the sintered magnet body after all. As a result, it is possible to avoid an unwanted situation where the heavy rare-earth element RH, which is one of valuable rare natural resources, is wasted in vain. The reason why the element RH has a low vapor pressure but can still be supplied onto the outer periphery of the main phase grain inside the magnet would be the strong affinity between the main phase of the magnet body and the element RH.

Within the processing temperature range of the diffusion process to be carried out as an evaporation diffusion process, the RH bulk body never melts or softens but the heavy rare-earth element RH vaporizes (sublimes) from its surface. For that reason, the RH bulk body does not change its appearance significantly after having gone through the process step just once, and therefore, can be used repeatedly a number of times.

Besides, as the RH bulk bodies and the sintered magnet bodies are arranged close to each other, the number of sintered magnet bodies that can be loaded into a processing chamber with the same capacity can be increased. That is to say, high loadability is realized. In addition, since no bulky system is required, a normal vacuum heat treatment furnace may be used and the increase in manufacturing cost can be avoided, which is very beneficial in practical use.

During the heat treatment process, an inert atmosphere is preferably maintained inside the processing chamber. As used herein, the "inert atmosphere" refers to a vacuum or an atmosphere filled with an inert gas. Also, the "inert gas" may be a rare gas such as argon (Ar) gas but may also be any other gas as long as the gas is not chemically reactive between the RH bulk body and the sintered magnet body. The pressure of the inert gas is reduced so as to be lower than the atmospheric pressure. If the pressure of the atmosphere inside the processing chamber were close to the atmospheric pressure, then the heavy rare-earth element RH could not be supplied easily from the RH bulk body to the surface of the sintered magnet body. However, since the amount of the heavy rare-earth element RH diffused is determined by the rate of diffusion from the surface of the sintered magnet body toward the inner portion thereof, it should be enough to lower the pressure of the atmosphere inside the processing chamber to $10^2$ Pa or less, for example. That is to say, even if the pressure of the atmosphere inside the processing chamber were further lowered, the amount of the heavy rare-earth element RH diffused (and eventually the degree of increase in coercivity) would not change significantly. The amount of the heavy rare-earth element diffused is more sensitive to the temperature of the sintered magnet body, rather than the pressure.

The heavy rare-earth element RH that has traveled to reach the surface of the sintered magnet body and then get deposited there starts to diffuse toward the inner portion of the sintered magnet body through the grain boundary phase under the driving forces generated by the heat of the atmosphere and the difference in RH concentration at the interface of the sintered magnet body. In the meantime, a portion of the light rare-earth element RL in the $R_2Fe_{14}B$ phase is replaced with the heavy rare-earth element RH that has diffused and penetrated through the surface of the sintered magnet body. As a result, a layer including the heavy rare-earth element RH at a high concentration is formed in the outer periphery of the $R_2Fe_{14}B$ phase.

By forming such an RH concentrated layer, the magnetocrystalline anisotropy can be improved and the coercivity $H_{cJ}$ can be increased in the outer periphery of the main phase. That is to say, even by using a small amount of heavy rare-earth element RH, the heavy rare-earth element RH can diffuse and penetrate deeper into the sintered magnet body and the RH concentrated layer can be formed in the outer periphery of the main phase efficiently. As a result, the coercivity $H_{cJ}$ of the overall magnet can be increased with the decrease in remanence $B_r$ minimized.

According to the conventional method in which a film of a heavy rare-earth element RH (which will be referred to herein as an "RH film") is deposited on the surface of a sintered magnet body and then thermally treated to diffuse inside the sintered magnet body, the rate of deposition of the heavy rare-earth element RH such as Dy on the surface of the sintered magnet body (i.e., a film growth rate) is much higher than the rate of diffusion of the heavy rare-earth element RH toward the inner portion of the sintered magnet body (i.e., a diffusion rate). That is why an RH film is deposited to a thickness of several μm or more on the surface of the sintered magnet body and then the heavy rare-earth element RH is diffused from that RH film toward the inner portion of the sintered magnet body. However, the heavy rare-earth element RH that has been supplied from the RH film in solid phase, not in vapor phase, not only diffuses through the grain boundary but also makes an intragrain diffusion easily inside the main phase that is located in the surface region of the sintered magnet body, thus causing a significant decrease in remanence $B_r$. That region in which the heavy rare-earth element RH makes such an intragrain diffusion inside the main phase to decrease the remanence is limited to the surface region of the sintered magnet body (with a thickness of 100 μm to several hundred μm, for example).

On the other hand, according to the evaporation diffusion process, the heavy rare-earth element RH such as Dy that has been supplied in vapor phase impinges on the surface of the sintered magnet body and then quickly diffuses toward the inner portion of the sintered magnet body. This means that before diffusing and entering the main phase that is located in the surface region of the magnet body, the heavy rare-earth element RH will diffuse through the grain boundary phase at a higher rate and penetrate deeper into the sintered magnet body. That is to say, according to the evaporation diffusion process, the intragrain diffusion hardly occurs even in the surface region of the sintered magnet body.

The concentration of the RH to diffuse and introduce is preferably within the range of 0.05 wt % to 1.5 wt % of the overall magnet. This concentration range is preferred because at an RH concentration of more than 1.5 wt %, the intragrain diffusion would occur so much even in the crystal grains in the sintered magnet body that the decrease in remanence $B_r$ could be out of control, but because at an RH concentration of less than 0.05 wt %, the increase in coercivity $H_{cJ}$ would be insufficient. By conducting a heat treatment process for 10 to 180 minutes within the temperature range and the pressure range defined above, an amount of diffusion of 0.1 wt % to 1 wt % is realized. The process time means a period of time in which the RH bulk body and the sintered magnet body have temperatures of 700° C. to 1,100° C. and pressures of $10^{-5}$ Pa to 500 Pa. Thus, during this process time, their temperatures and pressures are not always kept constant.

The surface state of the sintered magnet body, into which RH has not been diffused or introduced yet, is preferably as close to a metal state as possible to allow the RH to diffuse and penetrate easily. For that purpose, the sintered magnet is preferably subjected to an activation treatment such as acid cleaning or blast cleaning in advance. According to a conventional technique other than the evaporation diffusion process, an oxide layer needs to be removed from the surface of the sintered magnet body by performing such an activation treatment. According to the evaporation diffusion process, however, when the heavy rare-earth element RH vaporizes and gets deposited in an active state on the surface of the sintered magnet body, the heavy rare-earth element RH will diffuse toward the inner portion of the sintered magnet body at a higher rate than the deposition rate of a solid layer. That is why the surface of the sintered magnet body may also have been oxidized to a certain degree as is observed right after a sintering process or a cutting process.

According to the evaporation diffusion process, even after the treatment, the heavy rare-earth element RH has a relatively low concentration in the grain boundary phase. The heavy rare-earth element RH that has been introduced by diffusion gets concentrated in the outer periphery of the main phase grain. As a result, the RH concentration becomes higher in the outer periphery of the main phase grain than in the grain boundary. This is probably because the evaporation diffusion process is a process that results in a relatively small amount of heavy rare-earth element RH supplied to the grain boundary phase and because the main phase has greater affinity to the heavy rare-earth element RH than the grain boundary phase does. Such a concentration distribution will not be realized by a method in which a Dy film is deposited on the surface of a sintered magnet body and then Dy is caused to diffuse from the Dy film into the inner portion of the sintered magnet body through a heat treatment process for diffusion or by two-alloy blending. This should be because according to those methods, too much heavy rare-earth element RH would be supplied to the grain boundary phase.

According to the evaporation diffusion process, the heavy rare-earth element RH can be diffused mainly through the grain boundary phase. For that reason, the heavy rare-earth element RH can be diffused deeper into the sintered magnet body more efficiently by controlling the process time.

The shape and size of the RH bulk bodies are not particularly limited. For example, the RH bulk bodies may have a plate shape or an indefinite shape (e.g., a stone shape). Optionally, the RH bulk bodies may have a lot of very small holes with diameters of several ten μm. The RH bulk bodies are preferably made of either at least one heavy rare-earth element RH or an alloy including RH. Also, the higher the vapor pressure of the material of the RH bulk bodies, the greater the amount of RH that can be introduced per unit time, and the more efficient. Oxides, fluorides and nitrides including a heavy rare-earth element RH have so low vapor pressures that evaporation diffusion hardly occurs under the conditions falling within these ranges of temperatures and degrees of vacuum. For that reason, even if the RH bulk bodies are made of an oxide, a fluoride or a nitride including the heavy rare-earth element RH, the coercivity cannot be increased effectively.

If the magnet that has gone through the evaporation diffusion process of the present invention is further subjected to an additional heat treatment process, the coercivity ($H_{cJ}$) and loop squareness ($H_K/H_{cJ}$) thereof can be further increased. The conditions of the additional heat treatment (including the process temperature and time) may be the same as those of the evaporation diffusion process.

The additional heat treatment process may be carried out by continuing the heat treatment process with the partial pressure of Ar raised to about $10^3$ Pa to prevent the heavy rare-earth element RH from vaporizing after the diffusion process is over. Alternatively, after the diffusion process has been finished once, only a heat treatment process may be carried out again under the same conditions as in the diffusion process but without arranging the RH evaporation source.

According to the present invention, the heavy rare-earth element RH may diffuse and permeate either through the entire surface, or just a part of the surface, of the sintered magnet body. To make RH diffuse and permeate through a part of the surface of the sintered magnet body, the rest of the sintered magnet body, through which RH should not diffuse and permeate, may be wrapped with foil of a material that is not easily reactive to the sintered magnet body (e.g., a thermal resistant alloy of Nb). Or the gap between the rest of the sintered magnet body through which RH should not diffuse and the RH bulk body may be shielded with a thermal resistant plate, for example. After that, the heat treatment may be carried out by the method described above. When such a shield is arranged, the sintered magnet body and the shield may be in contact with each other. In that case, however, the shield is preferably made of a material that is not reactive to the sintered magnet body. According to such a method, a magnet, of which the coercivity $H_{cJ}$ has been increased locally, can be obtained. If an appropriate shield is selected, the RH element will hardly be deposited on the shield and will never be wasted in vain.

Such a sintered magnet, of which the coercivity $H_{cJ}$ has been increased locally, will not achieve significant effects by itself. However, when applied to a product such as a rotor, a stator or any other permanent magnet driven rotating machine, even such a sintered magnet will achieve significant effects. In a permanent magnet driven rotating machine, for example, when its motor is started, demagnetization field is applied to the sintered magnet. However, it is believed that the demagnetization field is rarely applied uniformly to the entire sintered magnet. In that case, by locating a portion to which intense demagnetization field is applied through a simulation-based analysis and by diffusing the heavy rare-earth element RH through only that portion to increase the coercivity $H_{cJ}$, the irreversible demagnetization of the sintered magnet can be minimized. By diffusing only a required amount of heavy rare-earth element RH through just a portion to which the demagnetization field is applied, the amount of RH used can be further reduced compared to a situation where RH is simply diffused through the entire sintered magnet. As a result, a significant effect is achieved. Also, in a surface region in which the heavy rare-earth element RH has diffused, the remanence $B_r$ will decrease slightly even if the grain boundary diffusion has advanced preferentially. However, if RH is diffused just locally as described above, then the percentage of the non-RH-diffused portion increases and therefore, the remanence $B_r$ hardly decreases.

In such a sintered magnet, of which the coercivity $H_{cJ}$ has been increased by diffusing the heavy rare-earth element RH just locally, a surface region thereof in which RH has been diffused and another surface region in which RH has not been diffused would have mutually different lattice constants. Thus, the present inventors carried out an X-ray diffraction measurement using a CuK α ray. As a result, we discovered that the c-axis lengths $L_{C1}$ (Å) and $L_{C2}$ (Å) of the main phase crystal lattices in those surface regions in which RH was diffused and not diffused, respectively, satisfied the inequality:

$$L_{C2}-L_{C1}\geqq 0.02\ (\text{Å})$$

According to the graph shown in FIG. 5, for example, in the surface region in which the heavy rare-earth element RH was diffused, a variation in c-axis length was sensed at least to a depth of 200 μm under the surface. That is why a sintered magnet in which the heavy rare-earth element RH has been diffused just locally cannot be used so effectively in a small magnet with a thickness of 1 to 2 mm but should be used very effectively (i.e., with the decrease in remanence minimized) in a magnet with a thickness of at least 2 mm, preferably 3 mm or more.

As for a magnet with a thickness of less than 2 mm, the depth at which the c-axis length stops varying may well be less than 200 μm. For example, if the given magnet has a thickness of 1 mm, the depth at which the c-axis length stops varying may be reduced to approximately 100 μm by shortening the diffusion process time.

Hereinafter, preferred embodiments of a method for producing an R—Fe—B based rare-earth sintered magnet according to the present invention will be described.

(Embodiment)

First, an alloy including 25 mass % to 40 mass % of a rare-earth element R, 0.6 mass % to 1.6 mass % of B (boron) and Fe and inevitably contained impurities as the balance is provided. A portion (at 10 mass %) of R may be replaced with a heavy rare-earth element RH, a portion of B may be replaced with C (carbon), and a portion (at most 50 at %) of Fe may be replaced with another transition metal element such as Co or Ni. For various purposes, this alloy may contain about 0.01 mass % to about 1.0 mass % of at least one additive element M that is selected from the group consisting of Al, Si, Ti, V, Cr, Mn, Ni, Cu, Zn, Ga, Zr, Nb, Mo, Ag, In, Sn, Hf, Ta, W, Pb and Bi.

Such an alloy is preferably made by quenching a melt of a material alloy by strip casting, for example. Hereinafter, a method of making a rapidly solidified alloy by strip casting will be described.

First, a material alloy with the composition described above is melted by induction heating within an argon atmosphere to make a melt of the material alloy. Next, this melt is kept heated at about 1,350° C. and then quenched by single roller process, thereby obtaining a flake-like alloy block with a thickness of about 0.3 mm. Then, the alloy block thus obtained is pulverized into flakes with a size of 1 mm to 10 mm before being subjected to the next hydrogen pulverization process. Such a method of making a material alloy by strip casting is disclosed in U.S. Pat. No. 5,383,978, for example.

Coarse Pulverization Process

Next, the material alloy block that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This should prevent the coarsely pulverized powder from being oxidized or generating heat and would eventually minimize the deterioration of the magnetic properties of the resultant magnet.

As a result of this hydrogen pulverization process, the rare-earth alloy is pulverized to sizes of about 0.1 mm to several millimeters with a mean particle size of 500 μm or less. After the hydrogen pulverization, the decrepitated material alloy is preferably further crushed to finer sizes and cooled. If the material alloy unloaded still has a relatively high temperature, then the alloy should be cooled for a longer time.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and gets the powder further pulverized by its pulverizer. The powder, which has been pulverized by the pulverizer, is then collected in a collecting tank by way of the cyclone classifier. In this manner, a finely pulverized powder having a size of about 0.1 μm to about 20 μm (typically 3 μm to 5 μm) can be obtained. The pulverizing machine for use in such a fine pulverization process does not have to be a jet mill but may also be an attritor or a ball mill. Optionally, a lubricant such as zinc stearate may be added as an aid for the pulverization process.

Press Compaction Process

In this preferred embodiment, 0.3 wt % of lubricant is added to, and mixed with, the alloy powder, obtained by the method described above, in a rocking mixer, for example, thereby coating the surface of the alloy powder particles with the lubricant. Next, the alloy powder prepared by the method described above is compacted under an aligning magnetic field using a known press machine. The aligning magnetic field to be applied may have a strength of 1.5 to 1.7 tesla (T), for example. Also, the compacting pressure is set such that the green compact has a green density of about 4 g/cm$^3$ to about 4.5 g/cm$^3$.

Sintering Process

The powder compact described above is preferably sequentially subjected to the process of maintaining the compact at a temperature of 650° C. to 1,000° C. for 10 to 240 minutes and then to the process of further sintering the compact at a higher temperature (of 1,000° C. to 1,200° C., for example) than in the maintaining process. Particularly when a liquid phase is produced during the sintering process (i.e., when the temperature is in the range of 650° C. to 1,000° C.), the R-rich phase in the grain boundary phase starts to melt to produce a liquid phase. Thereafter, the sintering process advances to form a sintered magnet body eventually. The sintered magnet body can also be subjected to the evaporation diffusion process even if its surface has been oxidized as described above. For that reason, the sintered magnet body may be subjected to an aging treatment (at a temperature of 400° C. to 700° C.) or machined to adjust its size.

Evaporation Diffusion Process

Next, the heavy rare-earth element RH is made to diffuse and penetrate efficiently into the sintered magnet body thus obtained. More specifically, an RH bulk body, including the heavy rare-earth element RH, and a sintered magnet body are put into the processing chamber shown in FIG. 6 and then heated, thereby diffusing the heavy rare-earth element RH into the sintered magnet body while simultaneously supplying the heavy rare-earth element RH from the RH bulk body onto the surface of the sintered magnet body. After the evaporation diffusion process, an aging treatment may be carried out at 400° C. to 700° C., if necessary.

In the evaporation diffusion process of this preferred embodiment, the temperature of the sintered magnet body is preferably set equal to or higher than that of the RH bulk body. As used herein, when the temperature of the sintered magnet body is equal to or higher than that of the RH bulk body, it means that the difference in temperature between the sintered magnet body and the RH bulk body is within 20° C. Specifically, the temperatures of the RH bulk body and the sintered magnet body preferably both fall within the range of 700° C. to 1,100° C., more preferably within the range of 850° C. to less than 1,000° C., and even more preferably within the range of 850° C. to 950° C. Also, the gap between the sintered magnet body and the RH bulk body should be within the range of 0.1 mm to 300 mm as described above.

Also, the pressure of the atmospheric gas during the evaporation diffusion process preferably falls within the range of $10^{-5}$ Pa to 500 Pa. Then, the evaporation diffusion process can be carried out smoothly with the vaporization (sublimation) of the RH bulk body advanced appropriately. To carry out the evaporation diffusion process efficiently, the pressure of the atmospheric gas preferably falls within the range of $10^{-3}$ Pa to 1 Pa. Furthermore, the amount of time for maintaining the temperatures of the RH bulk body and the sintered magnet body within the range of 700° C. to 1,100° C. is preferably 10 to 600 minutes. It should be noted that the "time for maintaining the temperatures" refers to a period in which the RH bulk body and the sintered magnet body have temperatures varying within the range of 700° C. to 1,100° C. and pressures varying within the range of $10^{-5}$ Pa to 500 Pa and does not necessarily refer to a period in which the RH bulk body and sintered magnet body have their temperatures and pressures fixed at a particular temperature and a particular pressure.

The depth of the diffused layer may be changed to any of various values according to the combination of the process temperature and the process time. For example, if the diffusion process is carried out at a high temperature or for a long time, then the diffused layer will get deep.

It should be noted that the bulk body does not have to be made of a single element but may include an alloy of a heavy rare-earth element RH and an element X, which is at least one element selected from the group consisting of Nd, Pr, La, Ce, Al, Zn, Sn, Cu, Co, Fe, Ag and In. Such an element X would lower the melting point of the grain boundary phase and would hopefully promote the grain boundary diffusion of the heavy rare-earth element RH.

Also, during the evaporation diffusion process, very small amounts of Nd and Pr vaporize from the grain boundary phase. That is why the element X is preferably Nd and/or Pr because in that case, the element X would compensate for the Nd and/or Pr that has vaporized.

Optionally, after the diffusion process is over, the additional heat treatment process mentioned above may be carried out at a temperature of 700° C. to 1,100° C. If necessary, an aging treatment is also carried out at a temperature of 400° C. to 700° C. If the additional heat treatment is carried out at a temperature of 700° C. to 1,100° C., the aging treatment is preferably performed after the additional heat treatment has ended. The additional heat treatment and the aging treatment may be conducted in the same processing chamber.

In practice, the sintered magnet that has been subjected to the evaporation diffusion process is preferably subjected to some surface treatment, which may be a known one such as Al evaporation, electrical Ni plating or resin coating. Before the surface treatment, the sintered magnet may also be subjected to a known pre-treatment such as sandblast abrasion process, barrel abrasion process, etching process or mechanical grinding. Optionally, after the diffusion process, the sintered magnet body may be ground to have its size adjusted. Even after having gone through any of these processes, the coercivity can also be increased almost as effectively as always. For the purpose of size adjustment, the sintered magnet body is preferably ground to a depth of 1 μm to 300 μm, more preferably to a depth of 5 μm to 100 μm, and even more preferably to a depth of 10 μm to 30 μm.

It should be noted that the depth of the diffused layer is not always the same as, but is usually greater than, that of the region where two peaks of diffraction are observed on a (008) plane by X-ray analysis or that of the region where the c-axis length varies. This is because if the RH diffused layer is very thin, the intensity of diffraction in the X-ray analysis would be too low to detect any peaks of diffraction.

EXAMPLES

Example 1

First, as shown in the following Table 1 (where the unit is mass %), thin alloy flakes having a composition including 0 to 10 mass % of Dy and an average thickness of 0.2 mm to 0.3 mm were made by strip casting process:

TABLE 1

| Alloy | Nd | Dy | B | Co | Al | Cu | Fe |
|---|---|---|---|---|---|---|---|
| a | 32.0 | 0 | 1.00 | 0.90 | 0.15 | 0.10 | bal. |
| b | 29.5 | 2.5 | | | | | |
| c | 27.0 | 5.0 | | | | | |
| d | 24.5 | 7.5 | | | | | |
| e | 22.0 | 10.0 | | | | | |

Next, a vessel was loaded with those thin alloy flakes and then introduced into a hydrogen pulverizer, which was filled with a hydrogen gas atmosphere at a pressure of 500 kPa. In this manner, hydrogen was absorbed into the thin alloy flakes at room temperature and then desorbed. By performing such a hydrogen process, the thin alloy flakes were decrepitated to obtain a powder in indefinite shapes with a size of about 0.15 mm to about 0.2 mm.

Thereafter, 0.04 wt % of zinc stearate was added to the coarsely pulverized powder obtained by the hydrogen process and then the mixture was pulverized with a jet mill to obtain a fine powder with a size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at a temperature of 1,020° C. to 1,060° C. for four hours in a vacuum furnace, thus obtaining sintered blocks, which were then machined and cut into sintered magnet bodies having a thickness of 3 mm, a length of 10 mm and a width of 10 mm. In this manner, sintered magnet bodies a' through e' were obtained based on the alloy a through e shown in Table 1.

Figure 6:
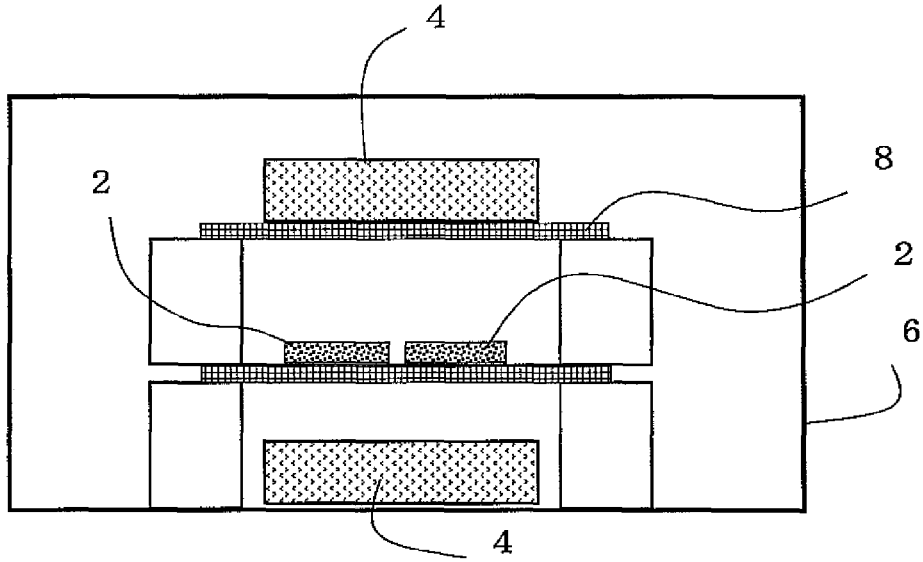
FIG. 6 is a cross-sectional view schematically illustrating a configuration for a process vessel that can be used effectively to make an R—Fe—B based anisotropic sintered magnet according to the present invention and an exemplary arrangement of RH bulk bodies and sintered magnet bodies in the process vessel.

These sintered magnet bodies a' through e' were acid-cleaned with a 0.3% nitric acid aqueous solution, dried, and then arranged in a process vessel with the configuration shown in FIG. 6. The process vessel for use in this preferred embodiment was made of Mo and included a member for holding a plurality of sintered magnet bodies and a member for holding two RH bulk bodies. A gap of about 5 mm to about 9 mm was left between the sintered magnet bodies and the RH bulk bodies. The RH bulk bodies were made of Dy with a purity of 99.9% and had dimensions of 30 mm×30 mm×5 mm.

Next, an evaporation diffusion process was carried out with the process vessel shown in FIG. 6 loaded into a vacuum heat treatment furnace. The process conditions were adjusted so that Dy diffused and introduced into the sintered magnet bodies a' through e' would have a concentration of 1.0 mass % by raising the temperature under a pressure of $1\times10^{-2}$ Pa and maintaining the temperature at 900° C. for three to five hours. In this manner, evaporated and diffused bodies A through E were obtained. Their compositions are shown in the following Table 2 (where the unit is mass %):

TABLE 2

| Diffused body | Nd | Dy | B | Co | Al | Cu | Fe |
|---|---|---|---|---|---|---|---|
| A | 31.0 | 1.0 | 1.00 | 0.90 | 0.15 | 0.10 | bal. |
| B | 28.5 | 3.5 | | | | | |
| C | 26.0 | 6.0 | | | | | |
| D | 23.5 | 8.5 | | | | | |
| E | 21.0 | 11.0 | | | | | |

These sintered magnet bodies a' through e' and evaporated and diffused bodies A through E were subjected an X-ray diffraction measurement, which was carried out using an X-ray diffractometer RINT2400 produced by Rigaku Corporation. The measuring conditions are shown in the following Table 3:

TABLE 3

| Ray source | Voltage (kV) | Current (mA) | Measuring range (2θ) | Step (degrees) | Scan speed (degrees/min) |
|---|---|---|---|---|---|
| Cu | 50 | 180 | 20-70 | 0.04 | 4.0 |

In order to make measurements on its plane parallel to the pole face, each sample was fixed on a sample holder so as to expose its plane with dimensions of 10 mm square, which was parallel to the pole face, exposed on the surface. As a result of an X-ray diffraction measurement that was carried out on that plane by the θ-2θ method, θ was calculated based on the peaks of diffraction on (004), (006) and (008) planes of the main phase crystal grains and the plane-to-plane interval was calculated by the equation $2d\times\sin\theta=\lambda$, where λ is the wavelength of an X-ray.

If two peaks indicating the presence of the (008) plane were observed, the smaller d value was used to calculate the c-axis length. The calculation was done by the equation described above.

As for the samples that had been subjected to the evaporation diffusion process, the X-ray diffraction measurement was carried out not only on the surface of their sintered body but also on the polished surface (with dimensions of 10 mm square) that had been exposed by polishing and removing the original surface of the sintered body to a depth of 40 μm, 80 μm, 120 μm, 200 μm or 300 μm and that was parallel to the pole face.

In addition, as a comparative example obtained by two-alloy blending method, powders of alloys a and e were blended together at a ratio of one to one to make a sintered magnet body f', of which the composition was the same as that of the sintered magnet body c' as a whole. The X-ray diffraction measurement was also carried out on that sample in the same way.

The results of measurements that were carried out on specific examples of the present invention, in which Dy had been evaporated and diffused, are shown in the following Table 4. On the other hand, the results of measurements that were carried out on samples in which Dy had not been evaporated and diffused (i.e., comparative examples) are shown in the following Table 5.

It should be noted that $M_{Dy}$ and $M_R$ denote the concentrations of Dy and R, respectively, which had been obtained by ICP analysis. The $M_{Dy}$ and $M_{Dy}/M_R$ values of a sample that had been subjected to the evaporation diffusion process are average concentrations (at %) in the entire sintered magnet that had been subjected to the diffusion process.

TABLE 4

| Diffused body | $M_{Dy}$ (at %) | $M_{Dy}/M_R$ | Depth (μm) | c-axis length (Å) | Number of peaks |
|---|---|---|---|---|---|
| A | 0.4 | 0.028 | 0 | 12.09 | 1 |
| | | | 40 | 12.17 | 2 |
| | | | 80 | 12.17 | 2 |
| | | | 120 | 12.17 | 1 |
| | | | 200 | 12.17 | 2 |
| | | | 300 | 12.20 | 1 |
| B | 1.4 | 0.098 | 0 | 12.09 | 2 |
| | | | 40 | 12.15 | 2 |
| | | | 80 | 12.16 | 1 |
| | | | 120 | 12.15 | 2 |
| | | | 200 | 12.15 | 2 |
| | | | 300 | 12.19 | 1 |
| C | 2.4 | 0.170 | 0 | 12.09 | 1 |
| | | | 40 | 12.14 | 2 |
| | | | 80 | 12.14 | 2 |
| | | | 120 | 12.13 | 2 |
| | | | 200 | 12.14 | 1 |
| | | | 300 | 12.17 | 1 |
| D | 3.4 | 0.243 | 0 | 12.08 | 1 |
| | | | 40 | 12.13 | 2 |
| | | | 80 | 12.13 | 2 |
| | | | 120 | 12.13 | 2 |
| | | | 200 | 12.16 | 1 |
| | | | 300 | NA | NA |

TABLE 4-continued

| Diffused body | $M_{Dy}$ (at %) | $M_{Dy}/M_R$ | Depth (μm) | c-axis length (Å) | Number of peaks |
|---|---|---|---|---|---|
| E | 4.4 | 0.317 | 0 | 12.07 | 1 |
| | | | 40 | 12.11 | 2 |
| | | | 80 | 12.11 | 2 |
| | | | 120 | 12.11 | 1 |
| | | | 200 | 12.14 | 1 |
| | | | 300 | NA | NA |

TABLE 5

| Sintered body | $M_{Dy}$ (at %) | $M_{Dy}/M_R$ | Depth (μm) | c-axis length (Å) | Number of peaks |
|---|---|---|---|---|---|
| a' | 0.0 | 0.000 | 0 to 500 | 12.20 | 1 |
| b' | 1.0 | 0.072 | 0 to 500 | 12.19 | 1 |
| c' | 2.0 | 0.146 | 0 to 500 | 12.17 | 1 |
| d' | 3.0 | 0.221 | 0 to 500 | 12.16 | 1 |
| e' | 4.0 | 0.297 | 0 to 500 | 12.14 | 1 |
| f' | 2.0 | 0.146 | 0 to 500 | 12.17 | 1 |

In Tables 4 and 5, the "number of peaks" indicates the number of peaks of diffraction that were observed within a 2θ range of 60.5 degrees through 61.5 degrees as a result of the X-ray diffraction measurements.

As can be seen from Table 4, in specific examples of the present invention that had been subjected to the evaporation diffusion process, there was a plane in which two peaks of diffraction were observed within a 2θ range of 60.5 to 61.5 degrees and which was located at a depth of 500 μm or less under the surface of the sintered body and parallel to the pole face. The present inventors also confirmed that the c-axis length became shorter in a region at a depth of 200 μm or less under the surface of the sintered body (=0 μm).

On the other hand, as can be seen from Table 5, in Samples a' through e' representing comparative examples that had not been subjected to the evaporation diffusion process and in Sample f' representing a comparative example in which two different kinds of alloy powders including Dy in mutually different concentrations were blended together and sintered, there were no planes in which two peaks of diffraction were observed within the 2θ range of 60.5 to 61.5 degrees at a depth of 500 μm or less under the surface of the sintered body.

Example 2

First, thin alloy flakes g to i were made by strip casting process so as to have the compositions shown in the following Table 6 (where the unit is mass %) and an average thickness of 0.2 mm to 0.3 mm:

TABLE 6

| Alloy | Nd | Pr | Dy | Tb | B | Co | Al | Cu | Fe |
|---|---|---|---|---|---|---|---|---|---|
| g | 26.0 | 6.0 | 0 | 0 | 1.00 | 0.90 | 0.15 | 0.10 | bal. |
| h | 21.0 | 6.0 | 5.0 | 0 | | | | | |
| i | 21.0 | 6.0 | 0 | 5.0 | | | | | |

Next, a vessel was loaded with those thin alloy flakes and then introduced into a hydrogen pulverizer, which was filled with a hydrogen gas atmosphere at a pressure of 500 kPa. In this manner, hydrogen was absorbed into the thin alloy flakes at room temperature and then desorbed. By performing such a hydrogen process, the thin alloy flakes were decrepitated to obtain a powder in indefinite shapes with a size of about 0.15 mm to about 0.2 mm.

Thereafter, 0.04 wt % of zinc stearate was added to the coarsely pulverized powder obtained by the hydrogen process and then the mixture was pulverized with a jet mill to obtain a fine powder with a powder particle size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at a temperature of 1,020° C. to 1,040° C. for four hours in a vacuum furnace, thus obtaining sintered blocks, which were then machined and cut into sintered magnet bodies having a thickness of 3 mm, a length of 10 mm and a width of 10 mm.

These sintered magnet bodies g' through i' obtained based on the alloy g through i shown in Table 6 were acid-cleaned with a 0.3% nitric acid aqueous solution, dried, and then arranged in a process vessel with the configuration shown in FIG. 6. The process vessel for use in this preferred embodiment was made of Mo and included a member for holding a plurality of sintered magnet bodies and a member for holding two RH bulk bodies. A gap of about 5 mm to about 9 mm was left between the sintered magnet bodies and the RH bulk bodies. The RH bulk bodies were made of Dy with a purity of 99.9% and had dimensions of 30 mm×30 mm×5 mm.

Next, an evaporation diffusion process was carried out with the process vessel shown in FIG. 6 loaded into a vacuum heat treatment furnace. The process conditions were adjusted so that Dy diffused and introduced into the sintered magnet bodies g' through i' would have a concentration of 1.0 mass % by raising the temperature under a pressure of $1\times10^{-2}$ Pa and maintaining the temperature at 900° C. for three to four hours. In this manner, evaporated and diffused bodies G through I were obtained. Their compositions are shown in the following Table 7 (where the unit is mass %). Thereafter, an X-ray diffraction measurement was carried out on each of those sintered magnet bodies g', h' and i' that had not been subjected to the evaporation diffusion process and Samples G, H and I that had been subjected to the evaporation diffusion process. As for Samples G, H and I that had been subjected to the evaporation diffusion process, the X-ray diffraction measurement was carried out at a depth of 100 μm under the surface of the sintered body and on that surface (i.e., at a depth of 0 μm). The results are shown in the following Table 8:

TABLE 7

| Diffused body | Nd | Pr | Dy | Tb | B | Co | Al | Cu | Fe |
|---|---|---|---|---|---|---|---|---|---|
| G | 25.0 | 6.0 | 1.0 | 0 | 1.00 | 0.90 | 0.15 | 0.10 | bal. |
| H | 20.0 | 6.0 | 6.0 | 0 | | | | | |
| I | 20.0 | 6.0 | 1.0 | 5.0 | | | | | |

TABLE 8

| Sintered body | $M_{RH}$ (at %) | $M_{RH}/M_R$ | Depth (μm) | c-axis length (Å) | Number of peaks |
|---|---|---|---|---|---|
| g' | — | 0.000 | 0 to 500 | 12.21 | 1 |
| h' | 2.0 | 0.145 | 0 to 500 | 12.18 | 1 |
| i' | 2.0 | 0.148 | 0 to 500 | 12.19 | 1 |

TABLE 8-continued

| | $M_{RH}$ (at %) | $M_{RH}/M_R$ | Depth (μm) | c-axis length (Å) | Number of peaks |
|---|---|---|---|---|---|
| Diffused body | | | | | |
| G | 0.4 | 0.028 | 0 | 12.10 | 2 |
| | | | 100 | 12.17 | 2 |
| H | 2.4 | 0.169 | 0 | 12.09 | 2 |
| | | | 100 | 12.14 | 2 |
| I | 2.4 | 0.172 | 0 | 12.10 | 2 |
| | | | 100 | 12.15 | 2 |

In Table 8, the "number of peaks" also indicates the number of peaks of diffraction that were observed within a 2θ range of 60.5 degrees through 61.5 degrees as a result of the X-ray diffraction measurements. In Table 8, $M_{RH}$ indicates the concentration of the heavy rare-earth element RH as the sum of the Dy and Tb concentrations (in at %)

As can be seen from Table 8, even if rare-earth elements other than Nd and Dy had been added to the material alloy, two peaks of diffraction were also observed in the 2θ range of 60.5 degrees through 61.5 degrees in the specific examples of the present invention.

Example 3

First, alloy thin flakes j having a composition consisting of 32.0 mass % of Nd, 1.00 mass % of B, 0.9 mass % of Co, 0.1 mass % of Cu, 0.2 mass % of Al and Fe as the balance were made by strip casting process so as to have a thickness of 0.2 mm to 0.3 mm.

Next, a vessel was loaded with those thin alloy flakes and then introduced into a hydrogen pulverizer, which was filled with a hydrogen gas atmosphere at a pressure of 500 kPa. In this manner, hydrogen was absorbed into the thin alloy flakes at room temperature and then desorbed. By performing such a hydrogen process, the thin alloy flakes were decrepitated to obtain a powder in indefinite shapes with a size of about 0.15 mm to about 0.2 mm.

Thereafter, 0.04 wt % of zinc stearate was added to the coarsely pulverized powder obtained by the hydrogen process and then the mixture was pulverized with a jet mill to obtain a fine powder with a powder particle size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at a temperature of 1,020° C. for four hours in a vacuum furnace, thus obtaining sintered blocks, which were then machined and cut into sintered magnet bodies j' having a thickness of 3 mm, a length of 10 mm and a width of 10 mm.

The sintered magnet body j' was acid-cleaned with a 0.3% nitric acid aqueous solution, dried, and then arranged in a process vessel with the configuration shown in FIG. 6. The process vessel for use in this preferred embodiment was made of Mo and included a member for holding a plurality of sintered magnet bodies and a member for holding two RH bulk bodies. A gap of about 5 mm to about 9 mm was left between the sintered magnet bodies and the RH bulk bodies. The RH bulk bodies were made of Dy with a purity of 99.9% and had dimensions of 30 mm×30 mm×5 mm.

Next, an evaporation diffusion process was carried out with the process vessel shown in FIG. 6 loaded into a vacuum heat treatment furnace. The process conditions were adjusted so that Dy diffused and introduced into the sintered magnet body j' would have concentrations of 0.25 mass % and 0.5 mass % in Samples J1 and J2, respectively, by raising the temperature under a pressure of $1\times10^{-2}$ Pa and maintaining the temperature at 900° C. for one to two hours.

In addition, as a comparative example, another sample was made by depositing Dy on the sintered magnet body j' and then subjecting it to a heat treatment process for diffusion. Specifically, the following process steps were carried out.

First, the deposition chamber of the sputtering apparatus was evacuated to reduce its pressure to $6\times10^{-4}$ Pa, and then was supplied with high-purity Ar gas with its pressure maintained at 1 Pa. Next, an RF power of 300 W was applied between the electrodes of the deposition chamber, thereby performing a reverse sputtering process on the surface of the sintered magnet body for five minutes. This reverse sputtering process was carried out to clean the surface of the sintered magnet body by removing a natural oxide film from the surface of the sintered magnet body.

Thereafter, a DC power of 500 W and an RF power of 30 W were applied between the electrodes of the deposition chamber to cause sputtering on the surface of the Dy target and deposit a Dy layer to thicknesses of 3.75 μm and 7.5 μm on the surface of the sintered magnet bodies J3 and J4, respectively. Next, the sintered magnet bodies, on which the Dy film had been deposited, were subjected to a heat treatment process for diffusion at 900° C. for two hours within a reduced-pressure atmosphere of $1\times10^{-2}$ Pa.

Subsequently, each of the sintered magnet body j' that had not been subjected to the evaporation diffusion process, Samples J1 and J2 that had been subjected to the evaporation diffusion process, and Samples J3 and J4 that were subjected to the heat treatment process for diffusion after the Dy film had been deposited thereon, was subjected to an aging treatment at 500° C. for two hours under a pressure of 1 Pa.

These samples were magnetized with a pulsed magnetizing field with a strength of 3 MA/m and then their magnet performances (including remanence $B_r$ and coercivity $H_{cJ}$) were evaluated.

Also, the surface of those samples, having dimensions of 10 mm square, was polished and removed to respective depths of 0 μm, 40 μm, 80 μm and 120 μm, at which an X-ray diffraction measurement was carried out. And at each of these depths, the c-axis length was measured and the peaks of diffraction on a (008) plane were observed within the range of 60.5 degrees to 61.5 degrees. The results of those measurements are shown in the following Table 9:

TABLE 9

| | $M_{Dy}$ (at %) | $M_{Dy}/M_R$ | Depth (μm) | c-axis length (Å) | Number of peaks | Coercivity $H_{cJ}$ (kA/m) |
|---|---|---|---|---|---|---|
| Sintered body | | | | | | |
| j' | 0.0 | 0.000 | 0to 500 | 12.02 | 1 | 960 |
| Diffused body | | | | | | |
| J1 | 0.1 | 0.007 | 0 | 12.12 | 2 | 1270 |
| | | | 40 | 12.17 | 2 | |
| | | | 80 | 12.20 | 1 | |
| | | | 120 | 12.20 | 1 | |
| J2 | 0.2 | 0.014 | 0 | 12.09 | 1 | 1350 |
| | | | 40 | 12.17 | 2 | |
| | | | 80 | 12.17 | 2 | |
| | | | 120 | 12.17 | 1 | |

TABLE 9-continued

| | $M_{Dy}$ (at %) | $M_{Dy}/M_R$ | Depth (μm) | c-axis length (Å) | Number of peaks | Coercivity $H_{cJ}$ (kA/m) |
|---|---|---|---|---|---|---|
| J3 | 0.1 | 0.007 | 0 | 12.14 | 1 | 1220 |
| | | | 40 | 12.20 | 1 | |
| | | | 80 | 12.20 | 1 | |
| | | | 120 | 12.20 | 1 | |
| J4 | 0.2 | 0.014 | 0 | 12.12 | 1 | 1310 |
| | | | 40 | 12.17 | 1 | |
| | | | 80 | 12.20 | 1 | |
| | | | 120 | 12.20 | 1 | |

As can be seen from Table 9, in Samples J3 and J4 in which a Dy film was deposited on the surface of the sintered body and then subjected to the heat treatment process for diffusion, two peaks of diffraction were not observed within the 2θ range of 60.5 to 61.5 degrees. The present inventors also discovered that when samples in which Dy had been diffused to the same concentration were compared to each other, Samples J1 and J2 representing specific examples of the present invention that had been subjected to the evaporation diffusion process had their coercivity $H_{cJ}$ increased more significantly than Samples J3 and J4 in which the Dy film had been deposited and then subjected to the heat treatment for diffusion. This means that according to the evaporation diffusion process, Dy would diffuse and reach deep inside the sintered magnet body more easily but would not reach the core of the main phases near the surface, and therefore, the coercivity $H_{cJ}$ increased efficiently.

Industrial Applicability

An R—Fe—B based anisotropic sintered magnet according to the present invention has had the concentration of a heavy rare-earth element RH increased efficiently in the outer periphery of the main phase grain, and therefore, its remanence and coercivity are good enough to use the present invention in various applications effectively.

The invention claimed is:

1. An R—Fe—B based anisotropic sintered magnet (where R is at least one of the rare-earth elements that include Y) comprising, as a main phase, an $R_2Fe_{14}B$ type compound that includes a light rare-earth element RL (which is at least one of Nd and Pr) as a major rare-earth element R, and also comprising a heavy rare-earth element RH (which is at least one element selected from the group consisting of Dy and Tb), wherein the magnet includes a portion in which at least two peaks of diffraction are observed within a 2θ range of 60.5 degrees to 61.5 degrees when an X-ray diffraction measurement is carried out using a CuKα ray on a plane that is located at a depth of 500 μm or less under a pole face of the magnet and that is parallel to the pole face.

2. The R—Fe—B based anisotropic sintered magnet of claim 1, wherein the portion in which the at least two peaks of diffraction are observed within the 2θ range of 60.5 degrees to 61.5 degrees when subjected to the X-ray diffraction measurement forms part of the plane that is parallel to the pole face.

3. The R—Fe—B based anisotropic sintered magnet of claim 1, wherein the portion in which the at least two peaks of diffraction are observed within the 2θ range of 60.5 degrees to 61.5 degrees when subjected to the X-ray diffraction measurement has an area of 1 $mm^2$ or more on the plane that is parallel to the pole face.

4. The R—Fe—B based anisotropic sintered magnet of claim 1, wherein if the concentrations of Nd, Pr, Dy and Tb are identified by $M_{Nd}$, $M_{Pr}$, $M_{Dy}$ and $M_{Tb}$ (at %), respectively, and satisfy the equations $$M_{Nd}+M_{Pr}=M_{RL},$$

$$M_{Dy}+M_{Tb}=M_{RH}, \text{ and}$$

$$M_{RL}+M_{RH}=M_R,$$

then the c-axis length Lc (Å) of the main phase satisfies, in the portion where the two peaks of diffraction are observed, the inequalities:

$$Lc \geqq 12.05, \text{ and}$$

$$Lc+(0.18-0.05\times M_{Tb}/M_{RH})\times M_{RH}/M_R-0.03\times M_{Pr}/M_{RL} \leqq 12.18 \text{ (where } 0<M_{RH}/M_R \leqq 4).$$

* * * * *